United States Patent [19]

Hazelton et al.

[11] 4,240,347

[45] Dec. 23, 1980

[54] BANKNOTE INTAGLIO PRINTING PRESS

[75] Inventors: Robert H. Hazelton, Bronx; John J. Kimball, Huntington Station, both of N.Y.

[73] Assignee: American Bank Note Company, New York, N.Y.

[21] Appl. No.: 938,903

[22] Filed: Sep. 1, 1978

[51] Int. Cl.[3] ..... B41F 9/10

[52] U.S. Cl. ..... 101/153; 101/157; 101/156; 101/168; 101/169

[58] Field of Search ..... 101/150, 153, 154, 156, 101/157, 168, 169

[56] References Cited

U.S. PATENT DOCUMENTS

| | | | |
|---|---|---|---|
| 1,539,202 | 5/1925 | Owen | 101/157 |
| 1,794,316 | 2/1931 | Newton | 101/157 |
| 1,927,056 | 9/1933 | Aitchison | 101/156 |
| 1,970,809 | 8/1934 | Marquardt | 101/156 |
| 2,278,138 | 3/1942 | Paardecamp | 101/157 |
| 2,506,011 | 5/1950 | Caulfield | 101/153 X |
| 2,550,454 | 4/1951 | Crafts et al. | 101/157 |
| 2,585,617 | 2/1952 | Battey | 101/156 |
| 2,832,286 | 4/1958 | Ferguson | 101/155 |
| 2,853,003 | 9/1958 | Kaldschmidt et al. | 101/216 |
| 3,756,152 | 9/1973 | Abler | 101/157 X |
| 3,877,369 | 4/1975 | D'Amato et al. | 101/157 |
| 3,888,172 | 6/1975 | D'Amato et al. | 101/156 |
| 3,894,488 | 7/1975 | Gazzola et al. | 101/153 |
| 4,009,657 | 3/1977 | Bonanno et al. | 101/157 |
| 4,066,014 | 1/1978 | Haaften | 101/157 |

FOREIGN PATENT DOCUMENTS

| | | | |
|---|---|---|---|
| 1108681 | 4/1968 | United Kingdom | 101/153 |

*Primary Examiner*—E. H. Eickholt

*Attorney, Agent, or Firm*—Cooper, Dunham, Clark, Griffin & Moran

[57] ABSTRACT

This printing press includes improved mechanism for removing excess ink from the printing plate. The press includes a main frame which supports a plate cylinder, a pressure cylinder vertically above the plate cylinder and a scraper blade which engages one side of the plate cylinder and removes most of the excess ink therefrom. A first auxiliary carriage at said one side of the main frame supports an ink supply mechanism and receptacles for receiving surplus ink removed by the scraper blade. A second auxiliary carriage, at the opposite side of the main frame, supports two wiping webs, their supply and take-up reels, and the driving and control mechanism for the webs and their reels. The wiping webs remove any residue of excess ink on the plate. Each auxiliary carriage is lockable in an operating position abutting the main frame, and is movable to a retracted position spaced from the main frame without disturbing the setting of any adjustable element.

17 Claims, 32 Drawing Figures

Fig. 5.
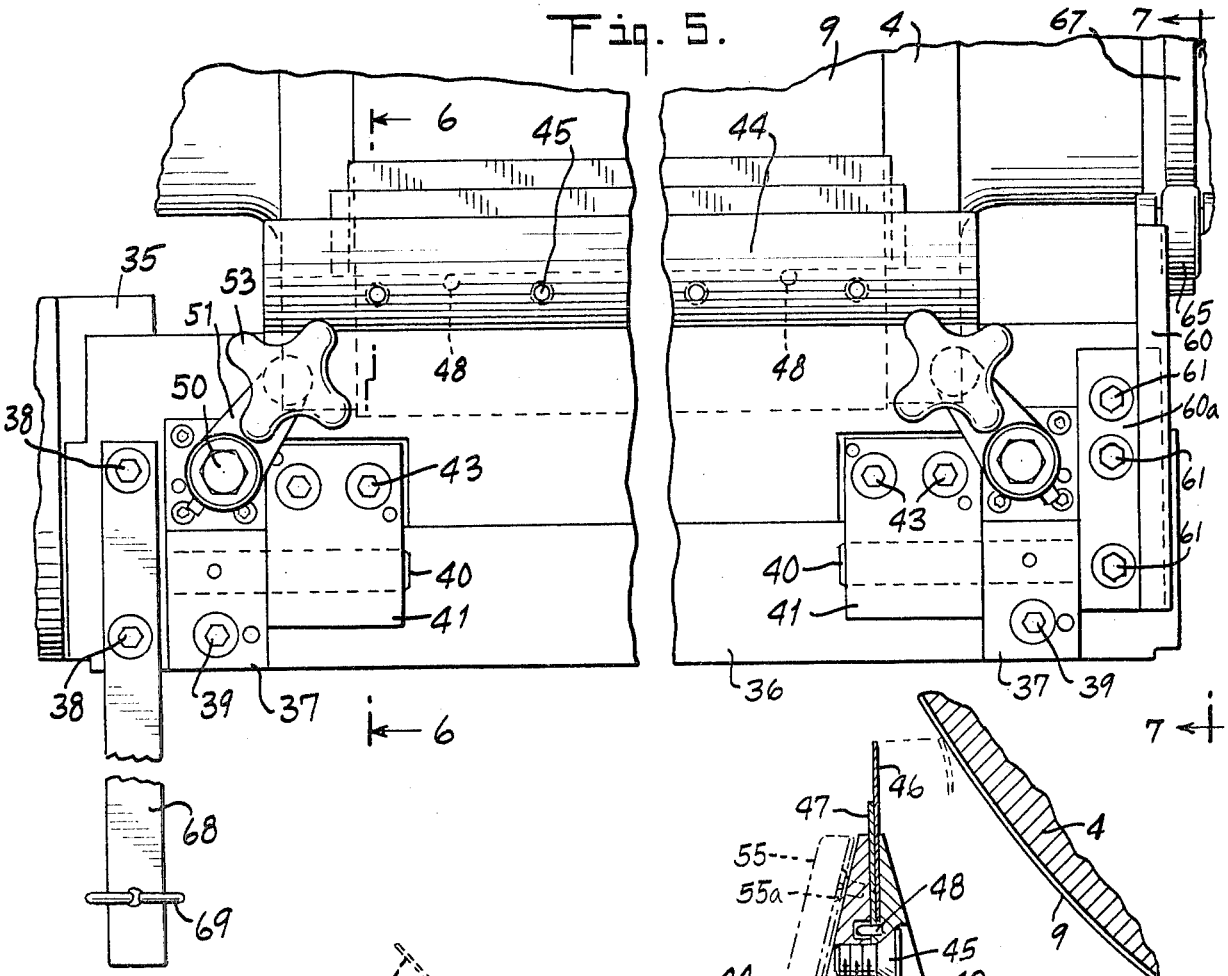
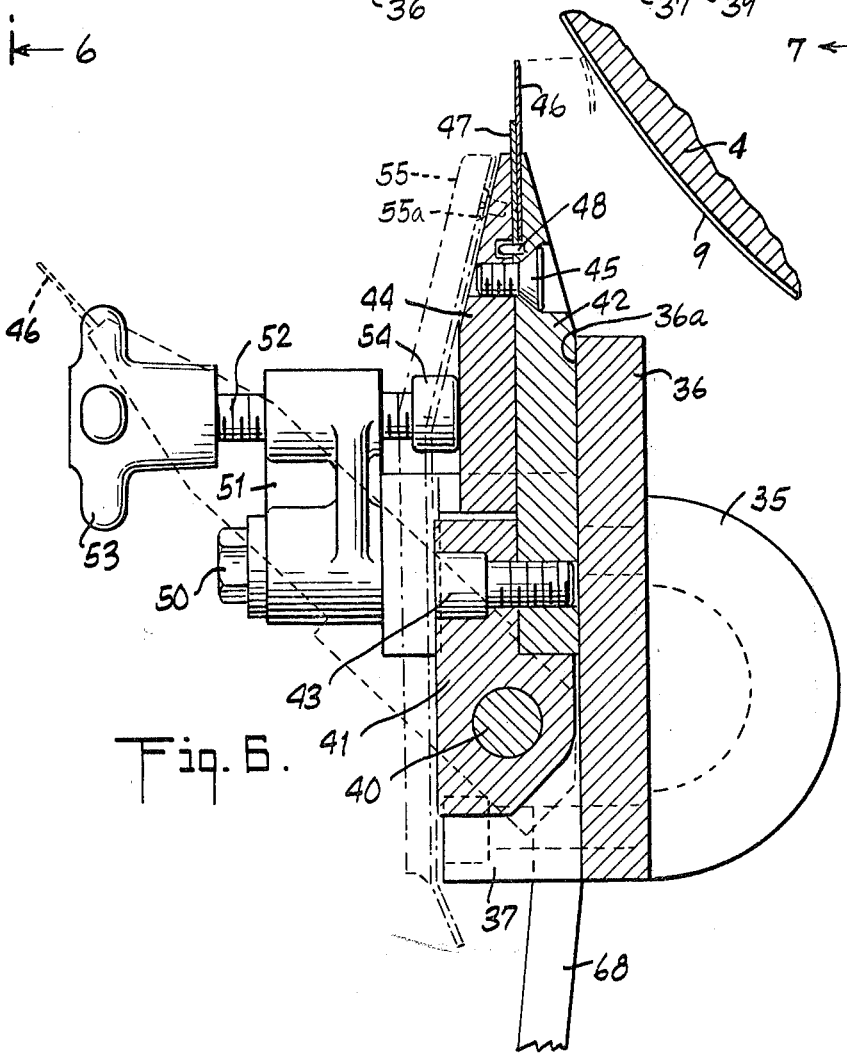
Fig. 6.

181
180
140c
140b
140a
140d
128

140d
140c
99
9A
128
180
181
9A
140
140a
140b
4
129
129a
46
60a
99
36
60
64
141
140d
140c
33
35

115
116
3b
113
106
107
105
110
160
88
119a
112
4
157
158
118
120
121
119
117
122
9
114
111
80
18
18
156
86
157
158
88b
88
88a
15
105
110
112
160
4
106
88d
107
15
3a
113

129
107
129a
147
146
149
148
145

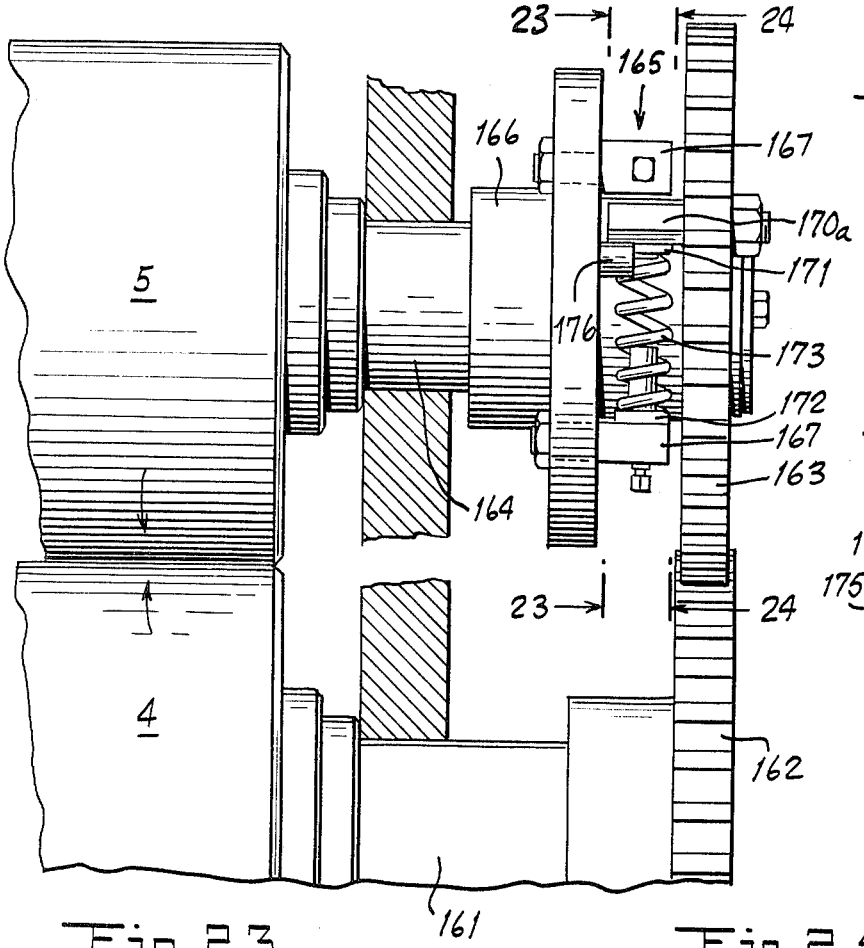
Fig. 22.
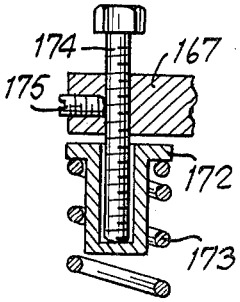
Fig. 25.
Fig. 23.
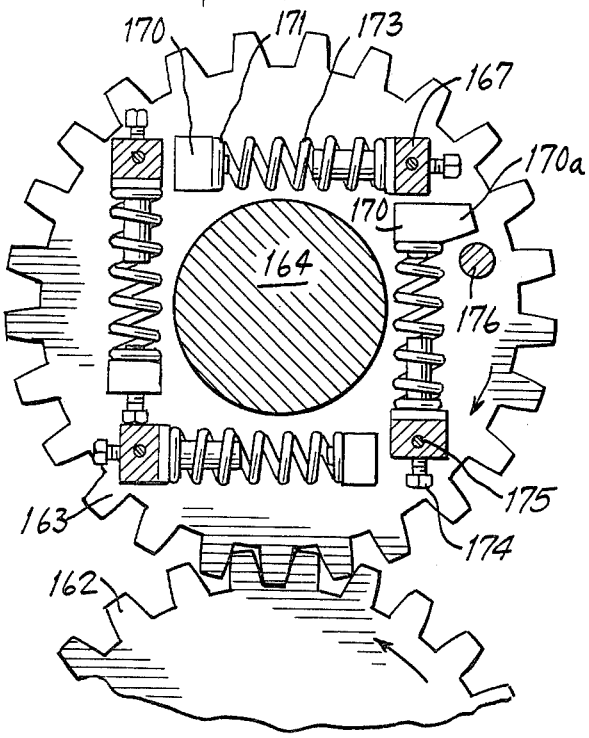
Fig. 24.
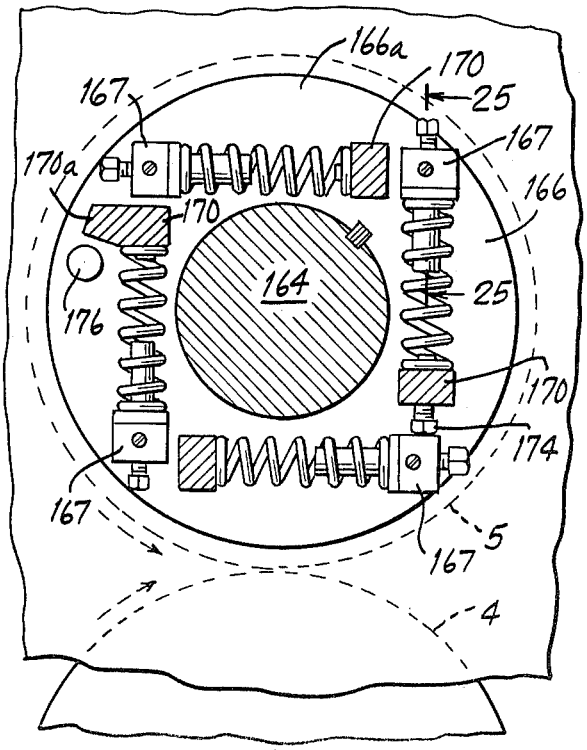

BANKNOTE INTAGLIO PRINTING PRESS

BACKGROUND OF THE INVENTION

The term "banknote intaglio printing" as used in this specification, is intended to define the type of intaglio printing commonly used to print documents of value and security papers such as banknotes, travelers checks, etc. In that type of printing, the image to be printed is formed in a printing plate by recesses, which may take the form of either dots or lines, and typically include straight and curved lines longer than 1 mm. (0.39 in.). The recesses vary in depth from 0.0005" to 0.010", and are first filled with ink. The paper is then forced into the recesses and a substantial thickness of ink is built up on the paper, i.e., from 0.0005" to 0.005". This type of printing is carried out with an ink having a viscosity of 50–500 poises at 20° C. The ink is usually heated and worked by a train of rollers to reduce its viscosity before it is applied to the printing plate. It adheres to the plate and to the bottoms of the recesses because of its viscous quality. After being applied to the plate, the excess ink on the surface between the recesses is removed either by a scraper blade and by one or more polishing webs of burlap or absorbent paper, or both. The paper to be printed is then pressed between the inked and polished plate and a pressure roller which is held against the plate with a force (commonly termed a "pressure") of 2000–8000 lbs. per lineal inch.

Other types of intagilo printing, such as those known as "photogravure" or "rotogravure", sometimes shortened to "gravure", use ink-receiving recesses in the form of dots with a surface area of less than 1 square mm. and which approximate circles, although they may be somewhat irregular in contour. They vary in depth up to 0.001". The ink vehicles used are highly volatile and have a viscosity of 1–5 poises at 20° C., and hence are readily flowable. They are applied by flooding the plate with liquid ink. The excess ink between the recesses is removed by a single doctor blade. The printing force is in the range from 20–200 lbs. per lineal inch.

The term "doctor blade", as used herein, defines a blade which makes an acute angle with that part of the cylindrical plate surface which is approaching the line of contact with the blade. The term "scraper blade" is used to define a blade which makes an acute angle with that part of the cylindrical plate surface which is receding from the line of contact with the blade.

BRIEF SUMMARY OF THE INVENTION

The invention is concerned with improved means for removing excess ink from the plate of a banknote intaglio press. The mechanism includes a scraper blade which engages the printing plate immediately after being contacted by the inking roll, and two wiping webs, which engage the plate after it leaves the scraper blade.

A main frame supports a plate cylinder and a pressure cylinder with their axes in vertical alignment and with the pressure cylinder above the plate cylinder. The main frame also supports the scraper blade and the mechanism for operating it. The plate extends for less than the full periphery of the cylinder and the scraper blade must be separated from the cylinder as the gap between the ends of the plate passes the blade. The blade is operated by a cam rotating with the cylinder. The cam forces the blade against the plate when the plate is adjacent the blade. The blade is retracted from the cylinder between the ends of the plate. The retraction may be by a spring or by a tracked cam, which acts positively on the follower in both directions. The force of engagement between the blade and the plate is determined completely by the cam contour and by the resilience of the blade itself. An adjustment is provided in the train of mechanism between the cam follower and the blade. The setting of that adjustment determines the operating position of the blade and hence the force of engagement.

The blade supporting structure is arranged so that the blade may be retracted from the plate for cleaning, or even completely removed, without disturbing the adjustment of the operating position of the blade.

A first auxiliary carriage supports conventional ink supply mechanism and two receptacles for receiving ink collected by the scraper blade. The carriage may be rolled along a suitable track between an operating position in which the ink supply mechanism engages the plate on the plate cylinder and a retracted position in which the plate cylinder is readily accessible. A set of tapered locating pins and mating recesses holds the auxiliary carriage in its operating position against lateral movement with respect to the main frame. A power actuated lock mechanism holds the carriage against movement toward and away from the main frame, and hence holds the locating pins firmly in their recesses.

The wiping webs and their supply and take-up reels are mounted on a second auxiliary carriage on the opposite side of the main frame from the first carriage. Each of the two wiping webs proceeds from its supply reel over suitable guides and over a wiping bar adjacent the plate cylinder. The position of the wiping bar determines the force with which the web is held against the plate cylinder. The web then proceeds over suitable guids to a take-up reel provided with an intermittent drive mechanism that advances the web during those intervals when the gap on the plate cylinder is aligned with the wiping bar. The supply reel is provided with a constant brake to maintain the web under tension and prevent the development of slack in the web. Separate means are provided for adjusting the positions of the opposite ends of the wiping bar with respect to the plate cylinder, and hence the pressure between the wiping bar and the cylinder. As in the case of the first auxiliary carriage, locating pins and a power actuated lock mechanism are provided to hold the second carriage in its operating position. To assist the wiping operation by the web, each wiping bar and the web thereon are reciprocated laterally of the plate cylinder. The locating pins prevent any lateral movement or vibration of the auxiliary carriage with respect to the main frame.

An improved pad is provided on the wiping bar to facilitate the movement of the wiping web between the bar and the printing plate. The pad is constructed for ready replacement.

The second auxiliary carriage may be moved from its operating position to its retracted position without disturbing the pressure adjustment on the two wiping bars. When the carriage is returned to its operating position, the locating pins and the lock mechanism ensure that all parts are restored to their proper operating positions.

The press herein employs a single plate on the plate cylinder. The various novel features of the invention are not limited in their utility to a single plate press. Furthermore, a single plate intaglio press is not new in itself.

A single plate press has several advantages over a multiple plate press in that it is not necessary to make duplicate plates. Hence, the plate cost is substantially lower. Furthermore, the manufacture of exact duplicate plates is, strictly speaking, impossible. Each of two nominally duplicate plates has high and low spots which are not repeated in the other plate. These differences must be corrected on the press by make ready operations which are not necessary on a single plate press. Furthermore, with a single plate, there is no necessity for locating the plates on the cylinder so that they register exactly.

A single plate press presents certain problems not encountered on a multiple plate press. For example, in order for a single plate press to print the same number of sheets per hour as a two plate press, the single plate cylinder must rotate at twice the angular velocity of the two plate cylinder. Vibration problems are therefore increased.

DRAWINGS

FIG. 5 is a fragmentary view similar to the middle portion of FIG. 3, but on a larger scale, and with a cover removed, showing additional details of the scraper blade and its support.

FIG. 6 is a sectional view taken on the line 6—6 of FIG. 5*a*.

FIG. 7 is a sectional view taken on the line 7—7 of FIG. 5.

Figure 2:
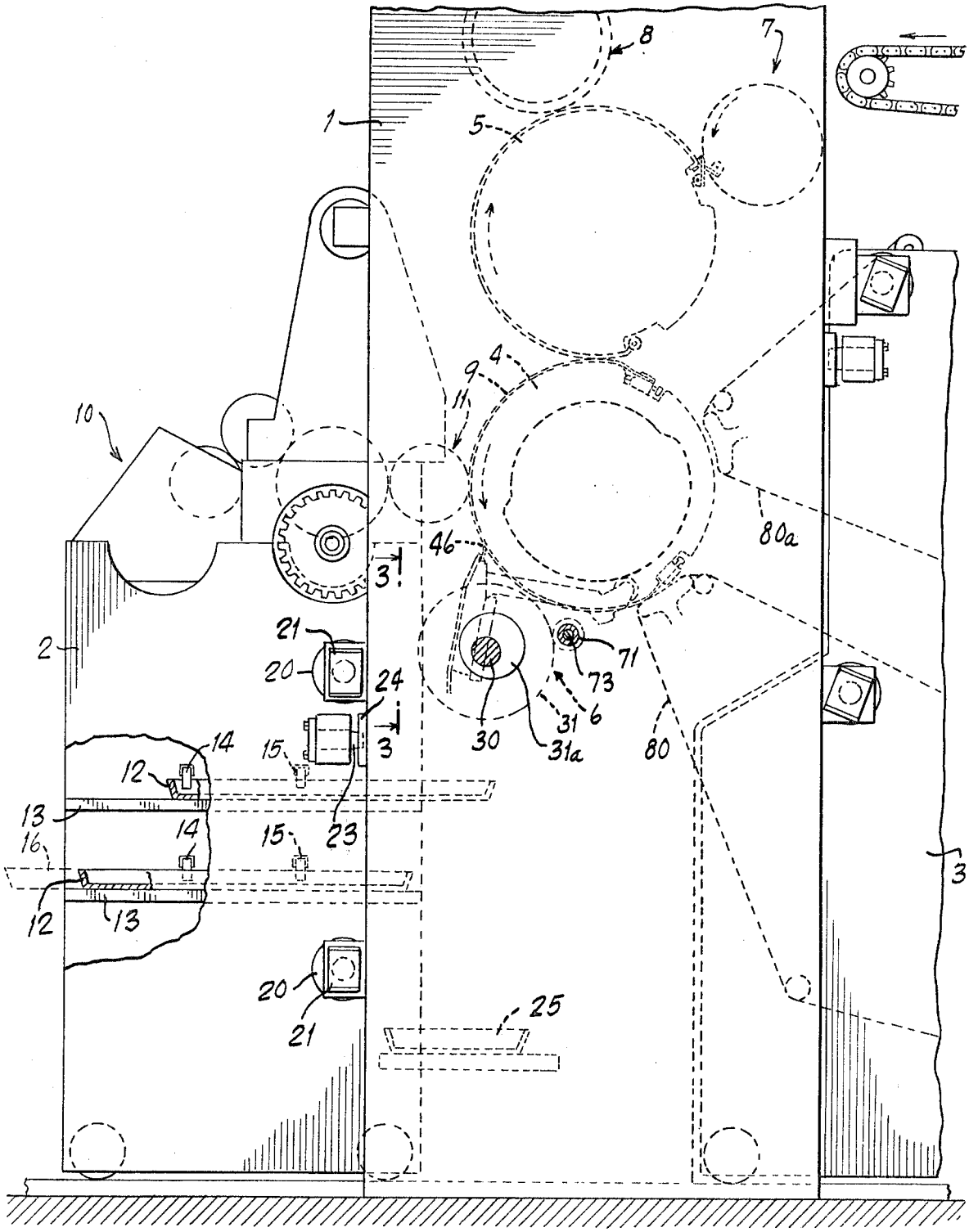
FIG. 2 is a fragmentary elevational view of a press embodying the invention, with certain parts broken away and others shown in section.
Figure 10:
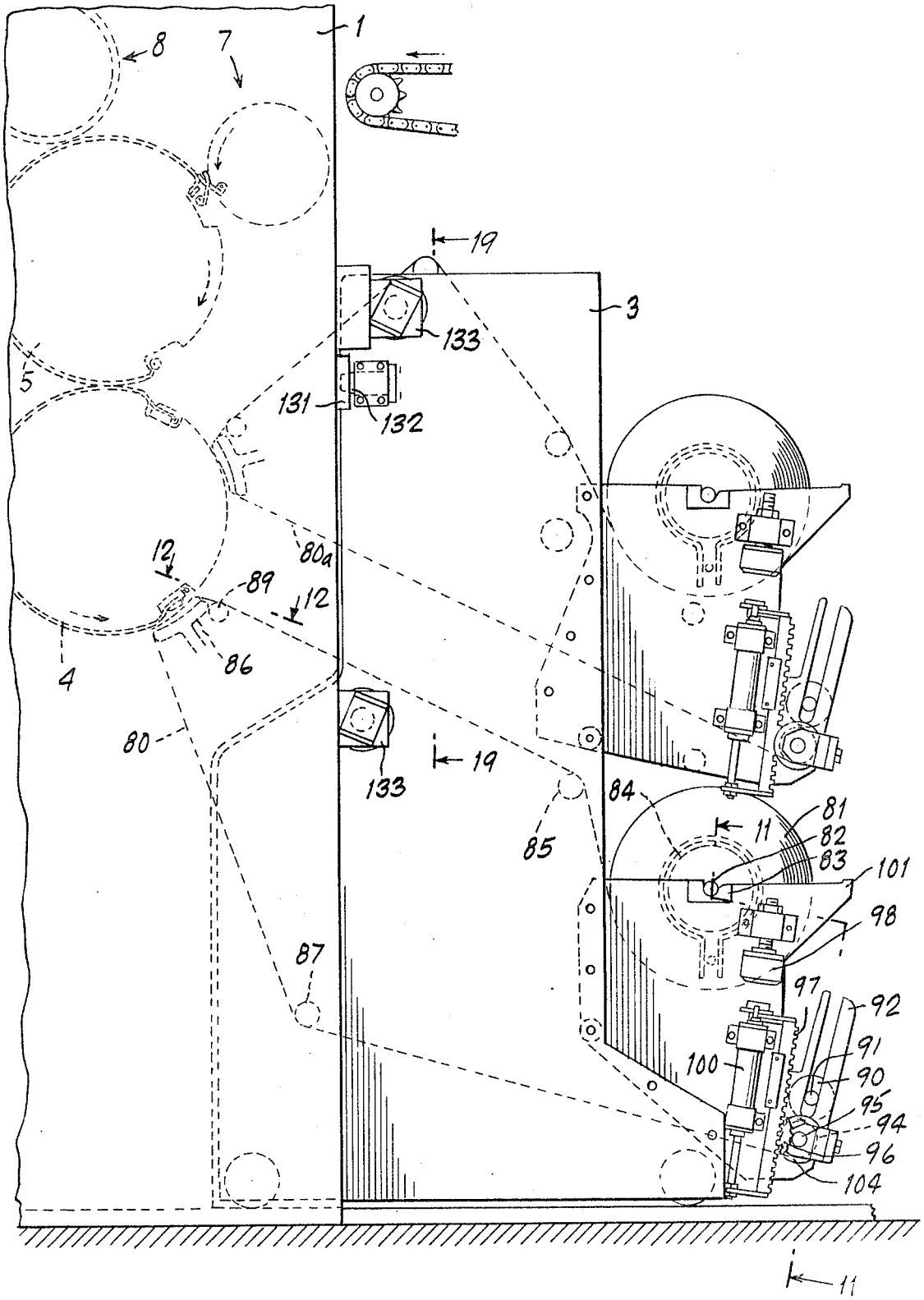
FIG. 10 is a fragmentary view showing part of the press in elevation.

FIGS. 2 and 10 together show the press without the auxiliary sheet feeding and delivery equipment.

Figure 11:
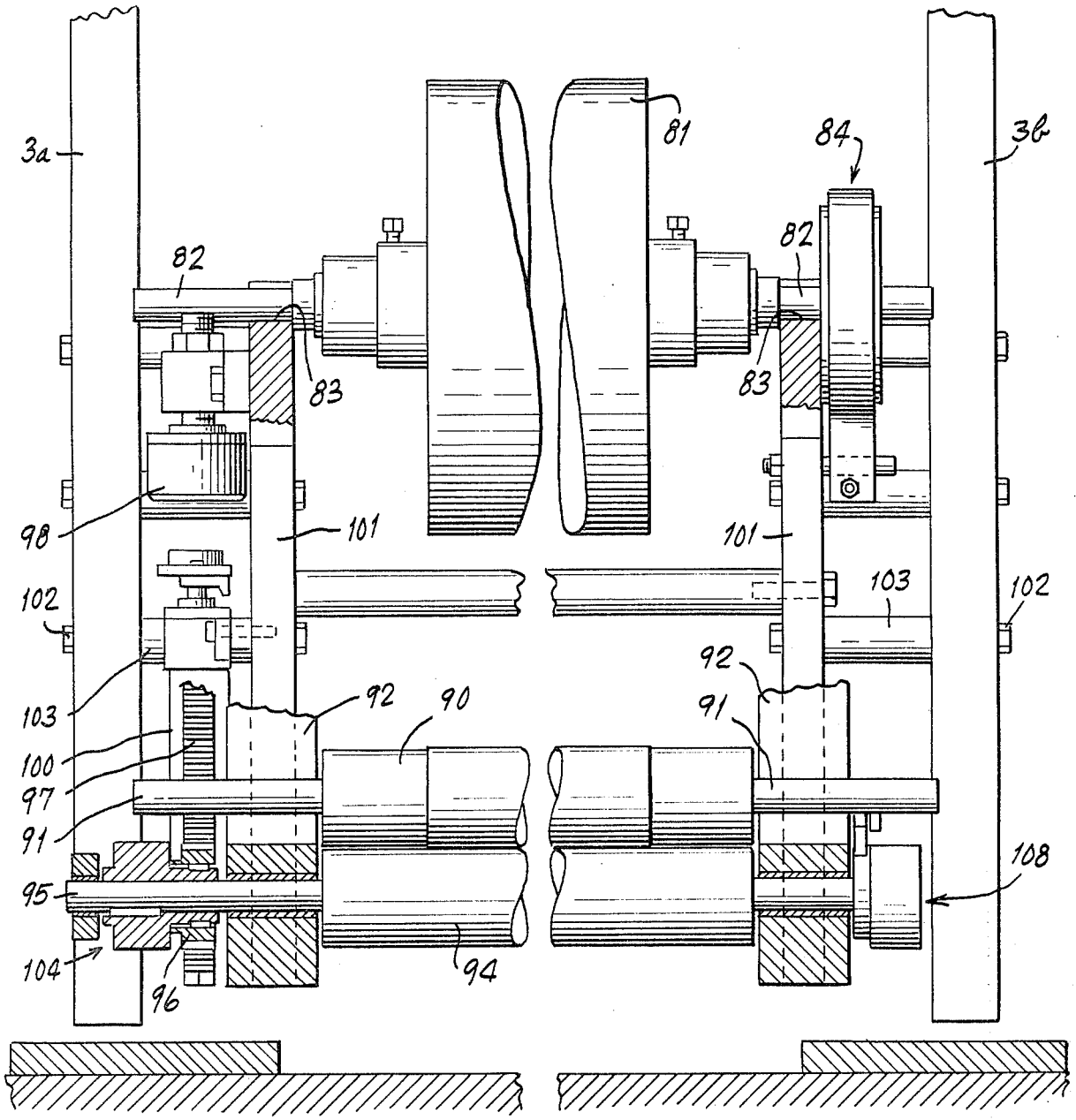

FIG. 11 is a fragmentary view, partly in section, taken on the line 11—11 of FIG. 10.

Figures 12, 13A:
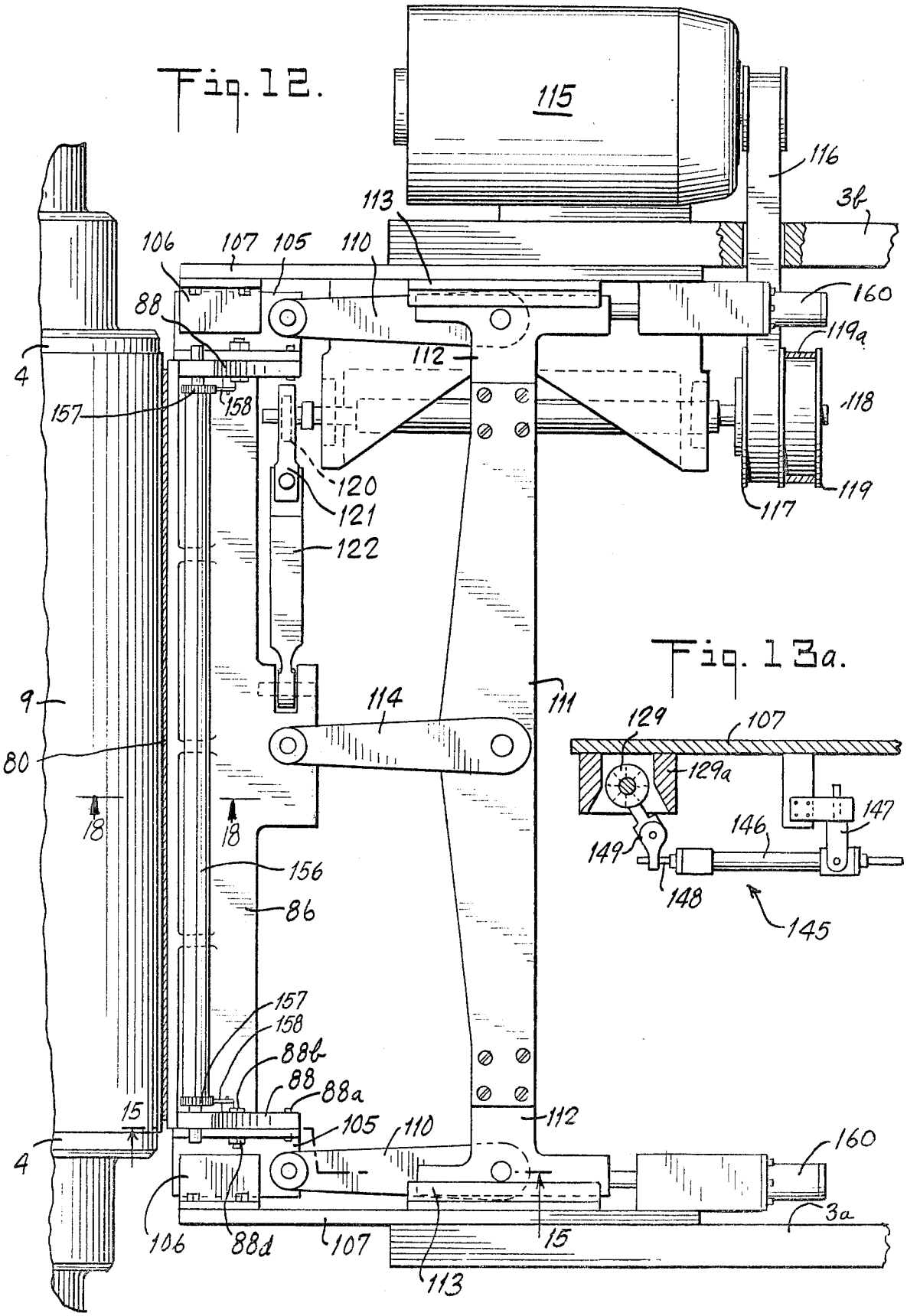

FIG. 12 is a sectional view taken on the line 12—12 of FIG. 10, on an enlarged scale.

Figures 13, 14:
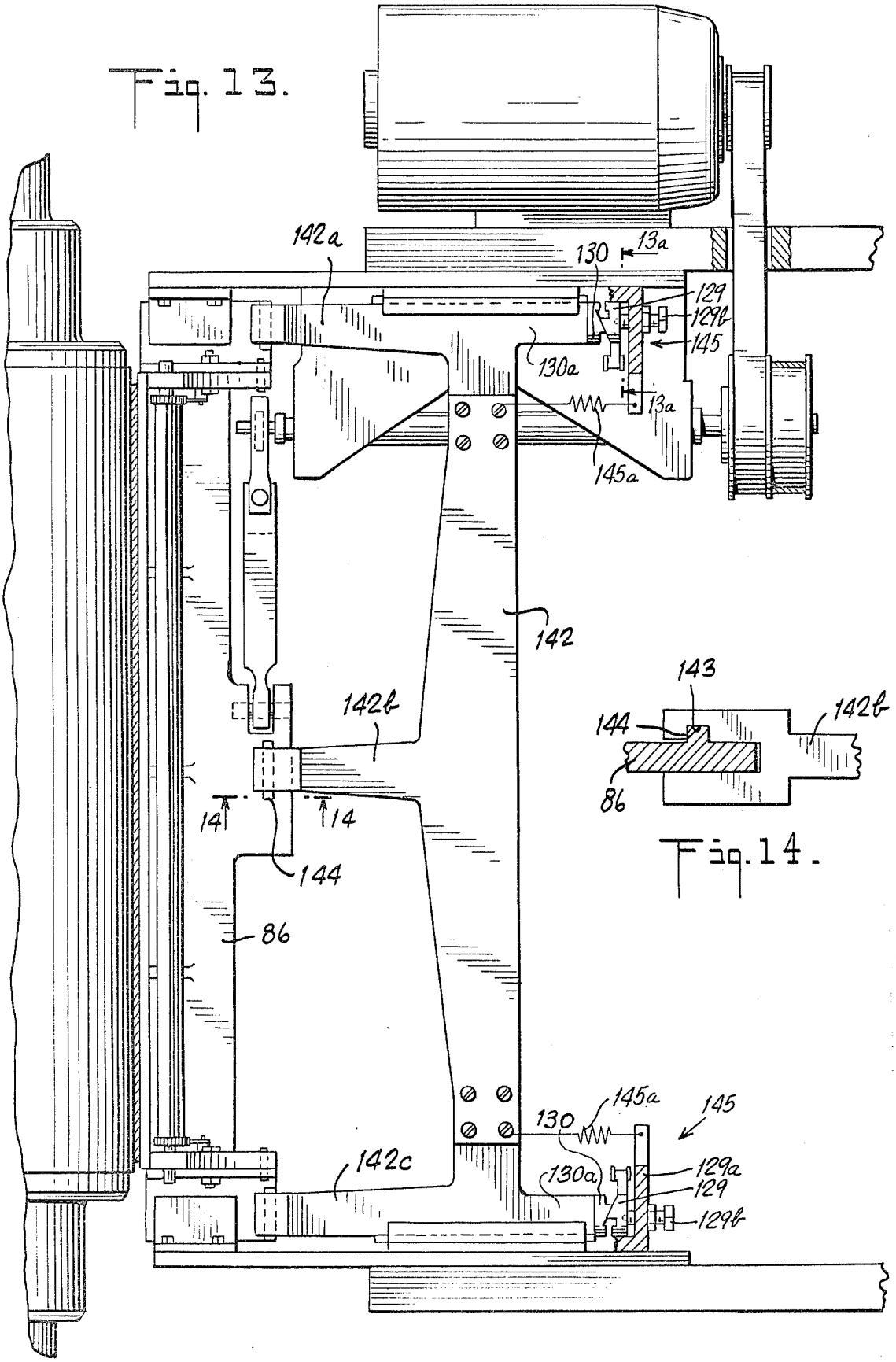

FIG. 13 is a view similar to FIG. 12, showing a modification.

FIG. 13*a* is a sectional view taken on the line 13*a*—13*a* of FIG. 13.

FIG. 14 is a fragmentary cross-sectional view on the line 14—14 of FIG. 13.

Figure 15:
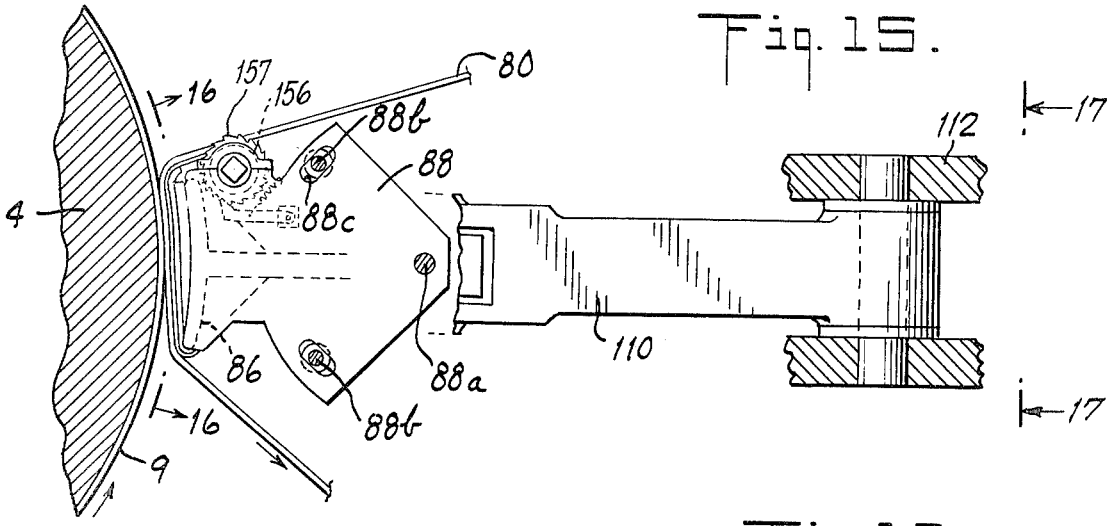

FIG. 15 is a sectional view taken on the line 15—15 of FIG. 12.

Figure 16:
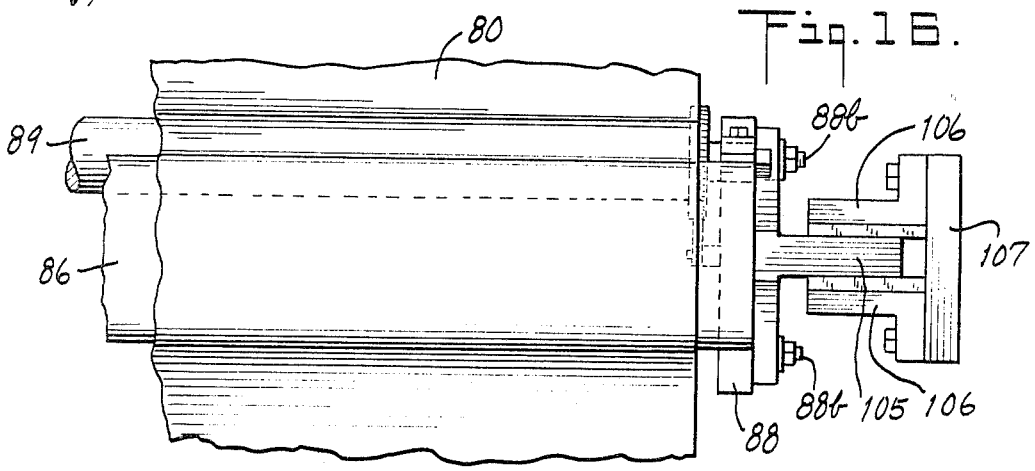

FIG. 16 is a fragmentary sectional view taken on the line 16—16 of FIG. 15.

Figure 17:
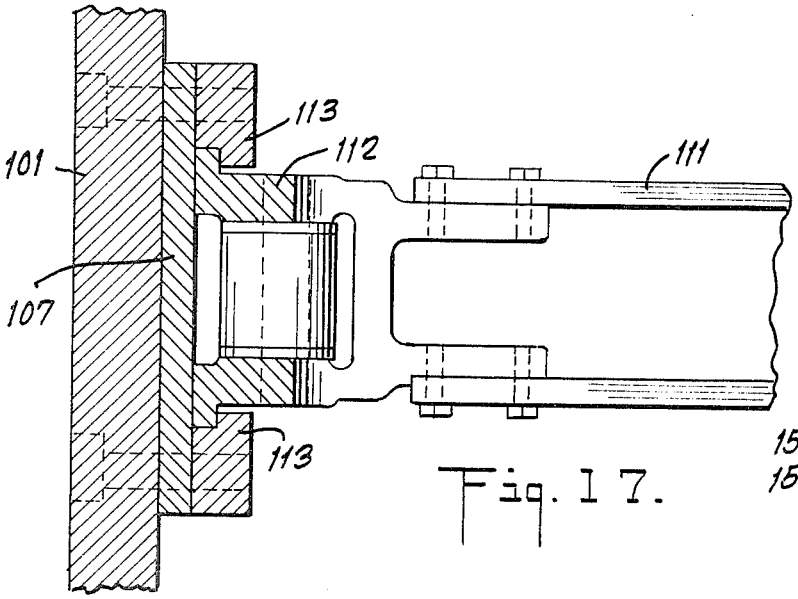

FIG. 17 is a sectional view taken on the line 17—17 of FIG. 15.

Figure 18:
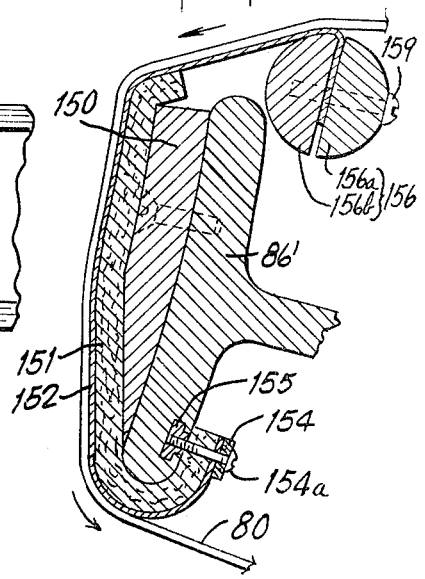

FIG. 18 is a fragmentary sectional view on the line 18—18 of FIG. 12.

Figure 19:
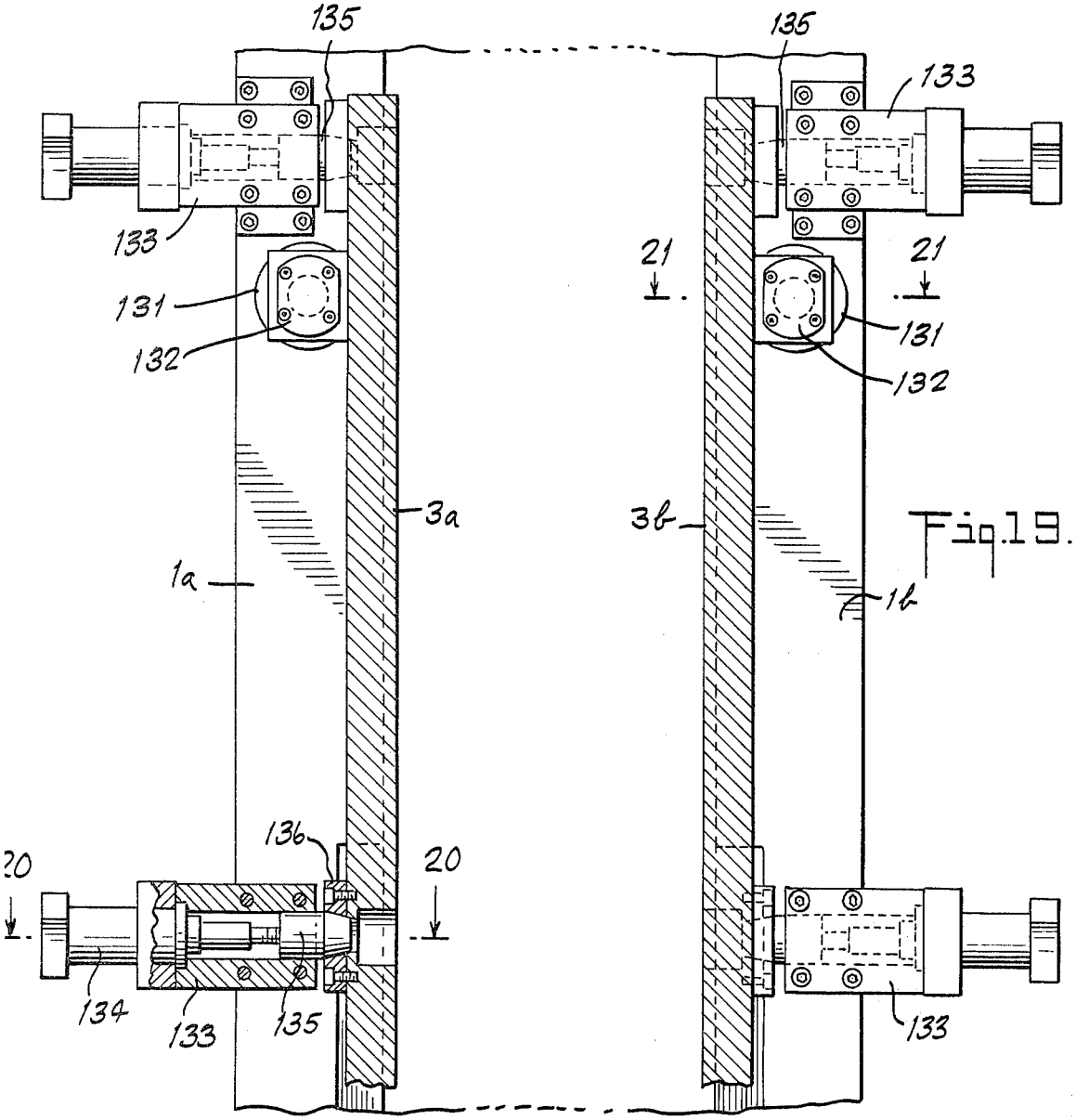

FIG. 19 is a sectional view taken on the line 19—19 of FIG. 10.

Figure 20:
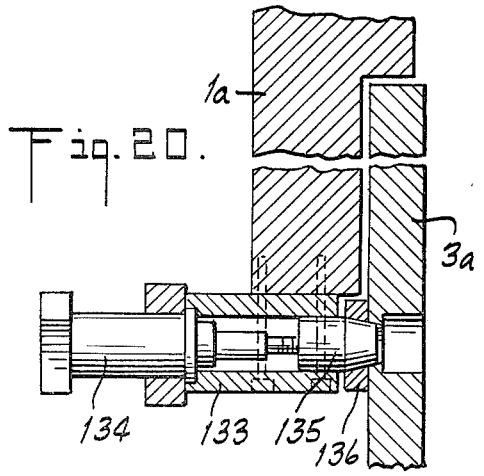

FIG. 20 is a sectional view taken on the line 20—20 of FIG. 19.

Figure 21:
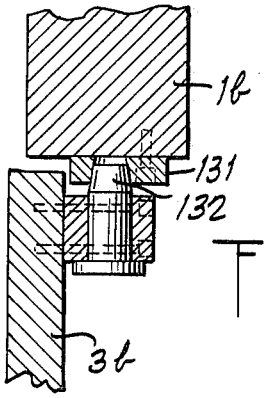

FIG. 21 is a sectional view taken on the line 21—21 of FIG. 19.

FIG. 22 is a fragmentary cross-sectional view, showing a detail of the drive gearing of the plate cylinder and the impression cylinder.

FIG. 23 is a cross-sectional view on the line 23—23 of FIG. 22.

FIG. 24 is a cross-sectional view on the line 24—24 of FIG. 22.

FIG. 25 is a fragmentary cross-sectional view taken on the line 25—25 of FIG. 24.

DETAILED DESCRIPTION

Figure 1:
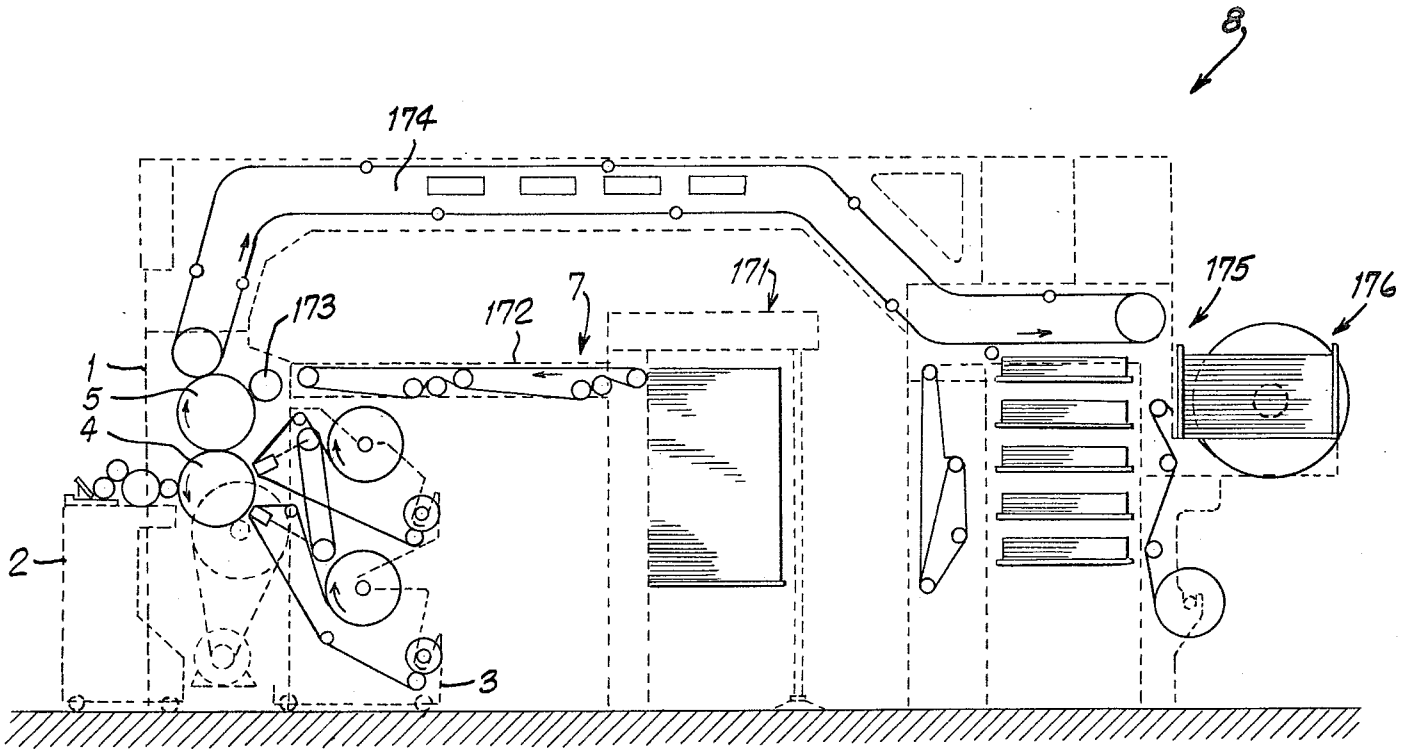
FIG. 1 is a somewhat schematic view of a press embodying the invention, together with auxiliary equipment such as sheet feeding and delivery mechanisms.

Referring particularly to FIGS. 1, 2 and 10, there is shown a printing press including a main frame 1, a first auxiliary carriage 2, and a second auxiliary carriage 3. The press is provided with a sheet feeding mechanism generally indicated at 7 and a sheet delivery mechanism generally indicated at 8. The sheet feeding and delivering mechanisms may be of any suitable conventional construction. The main frame 1 supports a plate cylinder 4, an impression cylinder 5 and a scraper blade mechanism generally indicated at 6, and including a scraper blade 46.

The first auxiliary carriage 2 supports an ink supply mechanism including an ink reservoir 10, and a train of rollers for transferring ink from the reservoir 10 to the plate cylinder and terminating in an inking roller 11 cooperating with a plate 9 on the plate cylinder 4. The ink supply mechanism may be of any suitable conventional type, and includes a means (not shown) for setting the position of inking roller 11 with respect to the carriage 2.

The carriage 2 also supports a pair of ink receiving receptacles 12 which rest on rails 13. Suitable stops 14 are provided to limit the movement of the receptacles 12 toward the press. The upper receptacle 12 is shown close to the stop 14 and is in its ink-receiving position under the scraper blade mechanism 6. A similar pair of stops 15 limits the outward movement of the receptacles 12. After one of the receptacles becomes filled with ink, it may be moved to an unloading position determined by stop 15, in which the receptacle projects outwardly from the carriage 2, as shown in dotted lines at 16 in FIG. 2. This allows the press operator access to the ink in the receptacle 12, so that he may return the ink to reservoir 10. The stop 15 also engages the upper surface of the receptacle 12 and thereby prevents the receptacle from tilting when it is in the unloading position shown at 16. Such a tilt might be occasioned by the weight of the ink in the receptacle, and might cause spilling of that ink. When one receptacle 12 is in its unloading position, the other is advanced to its ink receiving position under the scraper 6 to catch the ink dropping therefrom.

The main frame 1 also supports a set of power operated locks 21 which engage projections 20 on the auxiliary carrage 2 and hold the auxiliary carriage 2 in its operating position, with the ink supply roller 11 engaging the plate on the cylinder 4. A tapered pin 23 is mounted on the carriage 2 and engages a tapered recess formed in a projection 24 fixed on the frame 1. When the carriage is in its operating position, the pin 23 holds the carriage 2 against lateral movement (perpendicular to the plane of the drawings) with respect to the main frame 1 during operation of the press. The locks 21 hold the carriage against longitudinal movement from its operating position, and thereby hold the pin 23 in its recess.

The locks 21 and the pins 23 are similar in structure and function to the locks 133 and pins 132 described in detail below in connection with FIGS. 19–21.

Another ink receptacle 25 is supported on the main frame below the scraper 6 and serves to collect ink falling from the scraper blade after the carriage 2 has been moved to its retracted position.

The second auxiliary carriage 3 supports a wiping web 80 and a polishing web 80*a* and their related mechanisms, as described more completely below in connection with FIGS. 10–18.

FIGS. 2A–2C

These figures illustrate, on an enlarged scale, the operation of the mechanism for applying ink to the intaglio plate 9 and the operation of the scraper blade 46 and the wiping web 80 for removing the excess ink.

The operations illustrated in these figures are typical of banknote intaglio printing presses, including prior art presses as well as the press of the present invention. These illustrations show explicitly the operations in banknote intaglio presses which distinguish them from corresponding operations in other types of intaglio presses, e.g., rotogravure.

Figure 2A:
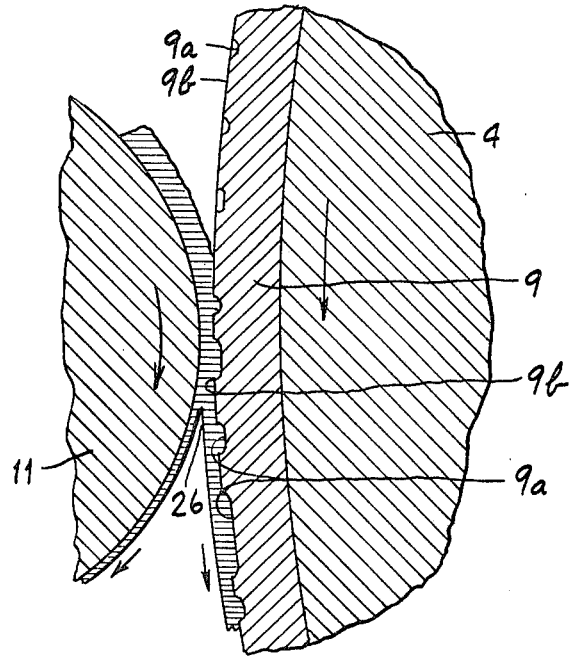
Fig. 2A. (PRIOR ART)
FIG. 2A is a cross-sectional view, on a greatly enlarged scale, illustrating the inking operation at the line of contact between the inking roller and the plate.

Referring to FIG. 2A, it may be seen that the intaglio plate 9 has on its printing surface ink-receiving recesses 9*a* (representing dots or lines to be printed) separated by smooth surfaces 9*b*. At the inking roller 11, there is deposited on the plate 9 a layer of ink generally indicated at 26, which fills the recesses 9*a* and also covers the surfaces 9*b* between those recesses.

Figure 2B:
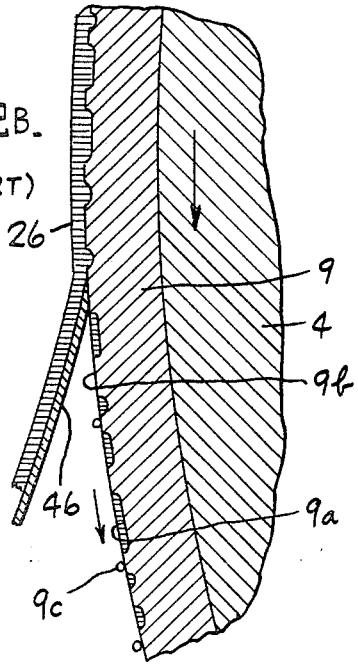
Fig. 2B. (PRIOR ART)
FIG. 2B is a cross-sectional view on a similar scale, illustrating the operation at the line of contact between the scraper blade and the intaglio plate.

Scraper blade 46, as may be seen in FIG. 2B, scrapes most of the ink of the layer 26 from the smooth surfaces 9*b* and leaves the recesses 9*a* filled with ink. A few droplets 9*c* of ink remain on some of the smooth surfaces, which are not completely cleaned by the blade 46.

Figure 2C:
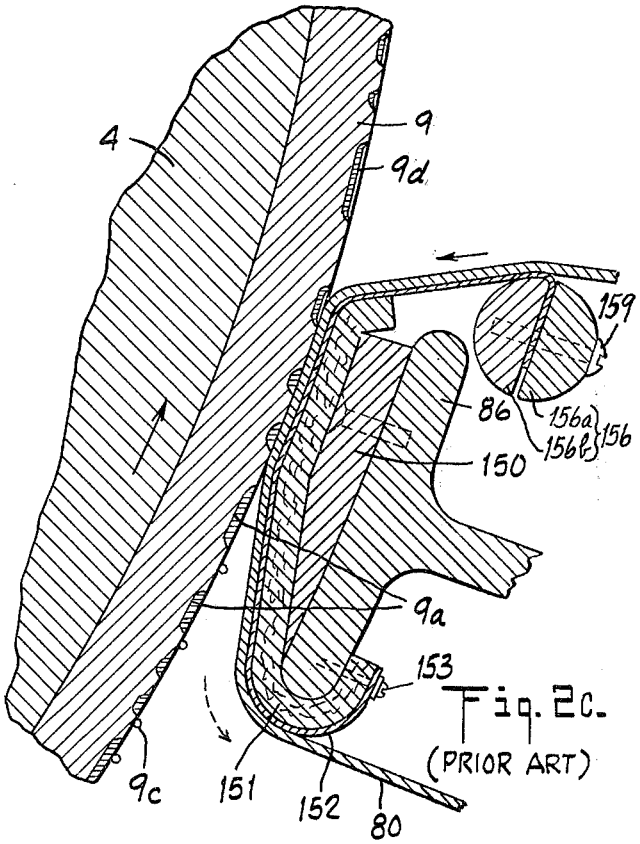
Fig. 2C. (PRIOR ART)
FIG. 2C is a cross-sectional view, on a similar scale, illustrating the operation at the area of contact between a wiping web and the intaglio plate.
Figure 3:
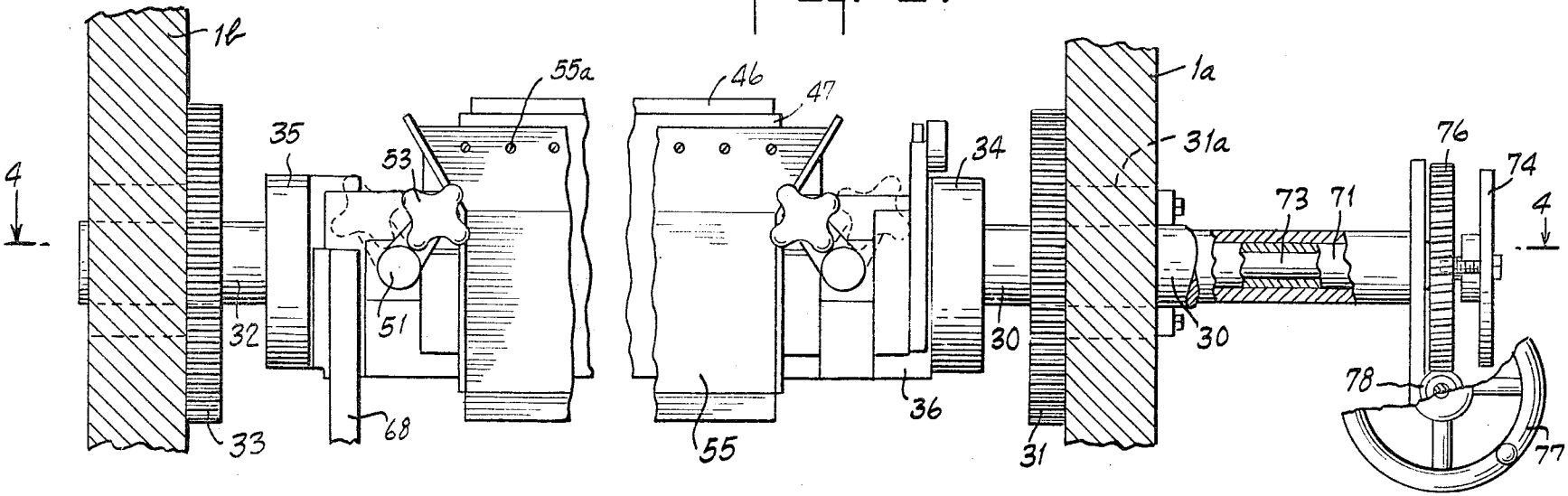
FIG. 3 is a fragmentary sectional view taken on the line 3—3 of FIG. 2, showing the scraper blade.
Figure 4:
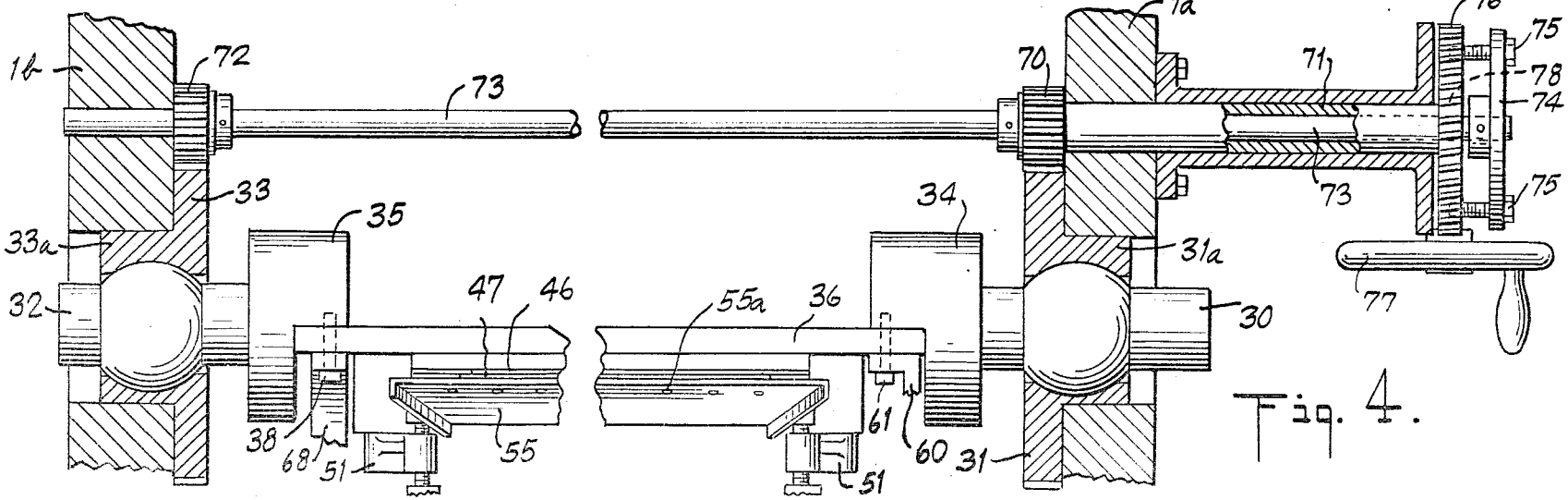
FIG. 4 is a fragmentary sectional view taken on the line 4—4 of FIG. 3, with certain parts broken away.
Figure 8:
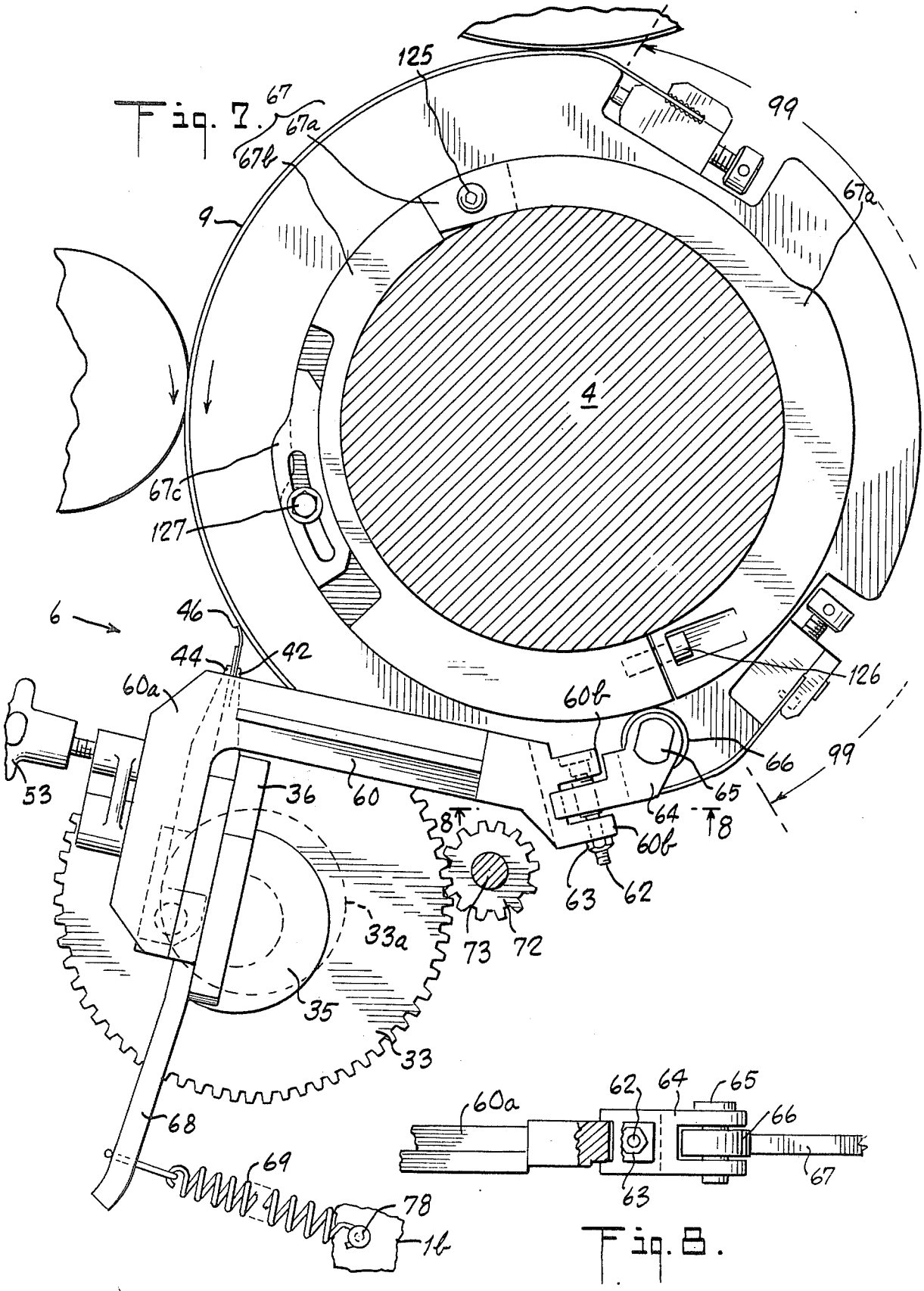
FIG. 8 is a sectional view taken on the line 8—8 of FIG. 7.

In FIG. 2C it may be seen that the wiping web 80 engages the plate 9 with increasing pressure toward the trailing edge of the web 80. Its effect is to remove almost all of the droplets 9*c* and to form a shallow meniscus 9*d* in the ink at each of the recesses 9*a*.

The second web 80*a* performs a similar function to the web 80, although it is commonly referred to as a polishing web, whereas the first web 80 is called a wiping web. The plate 9 is cleaner as it approaches the second web 80*a*, so that there is less ink to be removed by that web.

SCRAPER BLADE MECHANISM—FIGS. 3–9

The scraper blade mechanism indicated generally at 6 in FIG. 2 is shown in detail in FIGS. 3–9. The scraper blade mechanism is supported in two uprights 1*a* and 1*b* of the main frame 1. A stub shaft 30 is journaled eccentrically by means of a spherical bearing in the hub 31*a* of a gear 31. The hub 31*a* is journaled in the upright 1*a*. Another stub shaft 32 is journaled eccentrically by means of another spherical bearing in a hub 33*a* of a gear 33. The hub 33*a* journaled in the upright 1*b*. The two hubs 31*a* and 33*a* are horizontally aligned. When the two hubs 31*a* and 33*a* have the same angular position, the stub shafts 30 and 32 are also horizontally aligned. The stub shafts 30 and 32 carry at their inner ends a pair of blocks 34,35 having flat surfaces on which a datum member 36 is mounted by means of screws 38 and 61.

A pair of pads 37 (FIG. 5) are attached to the datum members 36 at the opposite ends thereof by means of screws 39. Each pad 37 supports a pivot pin 40. A pair of arms 41 are rotatably mounted on the pins 40 and project upwardly therefrom as seen in FIGS. 5 and 6. Each arm 41 supports a first jaw 42 by means of a pair of screws 43. A second jaw 44 is held to the first jaw 42 by means of screws 45. The jaws 42 and 44 are formed at their upper facing margins with recesses for receiving the lower margin of a scraper blade 46 and a stiffener plate 47. The scraper blade 46 is of resilient, wear resistant material, and may be 0.008" thick. The plate 47 is of thicker, more rigid material, and may be 0.020" thick.

Two locating pins 48 are fixed in or integral with the jaw 42 and extend into matching apertures in the jaw 44. The pins 48 span the recesses in which the blade 46 and plate 47 are received and thereby locate the bottom edges of blade 46 and plate 47. This construction facilitates accurate location of the blade 46 and plate 47, since only the upper surfaces of the pins 48 need to be accurately machined.

Each pad 37 also supports a screw 50 serving as a pivot pin for a locking arm 51. The end of the arm 51 threadedly receives a screw 52 whose outer end is provided with a hand wheel 53 and whose inner end is provided with a shoe 54. In the full-line positions shown in the drawings, the shoes 54 abut the jaw 44 and lock the jaw 42 against a datum surface 36*a* of the datum member 36 and thereby fix the position of the blade 46 with respect to the centers of the shafts 30 and 32. When it is desired to retract the blade 46 for cleaning or replacement, the hand wheels 53 are rotated to loosen the shoes 54 and the arms 51 are rotated to the dotted line positions shown in FIG. 3 to move the shoes 54 out of alignment with the jaws 44. The jaws 44,42 may then be turned with the arms 41 on the pins 40 to the retracted positions shown in dotted lines in FIG. 5, so that the blade 46 may be readily cleaned. When the jaws 42 and 44 are in their retracted positions, the screws 45 may be loosened to separate the jaws for replacement for the blade. After the blade 46 is cleaned or possibly replaced, it may be returned to its operating position by tightening the screws 45, rotating arms 41 back up to their operating positions and locking the jaw 42 against the datum surface 36*a* by means of the hand wheels 53 and screws 52.

A cover 55 is fixed on the jaw 44 by screws 55*a* and protects the scraper supporting and operating mechanism from ink falling from the blade 46. The cover 55 moves with the jaw 44 during blade cleaning and replacement operations.

An arm 60 has a flanged extension 60*a* which is fixed on the datum member 36 by means of screws 61. See FIGS. 5 and 7. The arm 60 is forked at its end, as shown at 60*b*. A bolt 62 is rotatably received in the tines of the forked end 60*b*. A lock nut 63 holds the bolt 62 against rotation. A follower carrier 64 is threaded on the bolt 62 and is forked at its end to embrace the arm 60. The carrier 64 supports a shaft 65 which rotatably carries a follower roller 66 cooperating with a cam 67 fixed on the hub of the plate cylinder 4.

When the parts are in the positions shown in FIG. 7, the cam 67 has forced the roller 66 outwardly, thereby rotating the hubs 31*a*, 33*a* and forcing the jaws 42,44 into a position where the blade 46 yieldably engages the plate 9 on the plate cylinder 4. The blade is laterally deflected by that engagement as shown in FIG. 7. Note that there is no resilient part in the train of mechanism between the roller 66 and the blade 46. Hence, the operating position of the blade 46 and the amount of its deflection is determined solely by the setting of the follower carrier 64 on the bolt 62. The force developed at the line of contact between the blade 46 and plate 9 is determined by the blade position and the resilience (i.e., the spring rate) of the blade.

Retraction of blade 46 to the dotted line position of FIG. 6 for cleaning or replacement does not disturb the setting of carrier 64 on bolt 62. Restoration of the jaws 42 and 44 to their operating positions by means of hand wheels 53 also restores the blade 46 to its previously set operating position.

After the roller 66 has been set, the positions of the ends of the blades 46 may be adjusted independently or together toward or away from the plate 9 by a mechanism for rotating the gears 31 and 33 together or gear 31 alone. (FIGS. 3 and 4) The gear 31 meshes with a pinion gear 70 fixed on a sleeve 71 journaled in the upright 1*a*. The gear 33 meshes with another pinion gear 72 fixed on a shaft 73. Shaft 73 is concentric with the sleeve 71 and extends through it. A disc 74 is fixed on the right-hand end of shaft 73, as viewed in FIGS. 3 and 4. Disc 74 is connectable by means of screws 75 to a worm gear 76 fixed on the sleeve 71 and rotatable by means of a worm 78 driven by a hand wheel 77. When the screws 75 are tightened to connect disc 74 to the gear 76, rotation of the hand wheel 77 turns both the pinions 70 and 72 concurrently and adjusts both ends of the blade 46. When the screws 75 are loosened to disconnect the disc 74 from the gear 76, then rotation of the hand wheel 77 turns the pinion 70 but not pinion 72 and thereby adjusts only the right-hand end of the blade 46 as viewed in FIG. 3. The spherical bearings in the hubs 31*a* and 33*a* allow the stub shafts 30 and 32 to tilt as required to accommodate this independent movement of the ends of blade 46. By appropriately adjusting the positions of the ends of the blade, the deflection of the blade may be made uniform throughout its length.

An arm 68 is attached by screws 38 to the datum member 36 at its left-hand end as seen in FIG. 5. A spring 69 (FIG. 7) connects the lower end of the arm 68 to an anchor pin 78 on the upright 1*b*. The spring 69 biases the datum member 36 to a position where the blade 46 is retracted from the surface of the plate 9 as shown in full lines in FIG. 6. This retraction is accomplished by spring 69 every time the follower roller 66 moves into the low portion of the cam 67. This takes place whenever the blade 46 is in the gap between the ends of the plate 9. When the blade 46 reaches the leading margin of plate 9, the cam 67 forces the blade back into scraping contact with the plate.

The cam 67 is made in two semicircular sections 67*a* and 67*b*. The sections 67*a* and 67*b* are connected at one end by a hinge pin 125 and fastened together at their opposite ends by a screw 126 which threadedly engages the section 67*b* and has its head received in a recess in the section 67*a*. The section 67*b* is provided with a circumferentially adjustable slotted section 67*c* by which the peripheral length of the high portion of the cam 67 may be adjusted. Section 67*c* is connected to section 67*b* by a bolt 127. The cam 67 may be rotated bodily on the cylinder 4 by releasing the screw 126 so as to separate the sections 67*a* and 67*b* slightly and allow the whole cam structure to turn on the cylinder. The circumferential position of the riser portion 67*a* is adjusted in that manner. The drop off portion of the cam is determined by the position of the adjustable section 67*c*, which may be moved circumferentially of the section 67*b* by releasing the bolt 127 and sliding the section 67*c* to the desired position. In this manner, the angular position of the plate cylinder 4 where the blade 46 engages the plate and the position where it is lifted from the plate may be adjusted.

FIG. 9

This figure illustrates a modification of the cam and follower structure shown in FIG. 7. The cam 67 of FIG. 7 is replaced in FIG. 9 by a tracked cam 140 having opposed cam surfaces 140*a* and 140*b*. The follower 66 of FIG. 7 is replaced by a follower 141. The follower 141 is positively driven by cam 140 in both directions. The blade 46 is thereby positively lifted away from plate 9 at the beginning of the gap 99 and is positively forced into engagement with the plate 9 at the end of gap 99.

Figures 9, 9A, 9B:
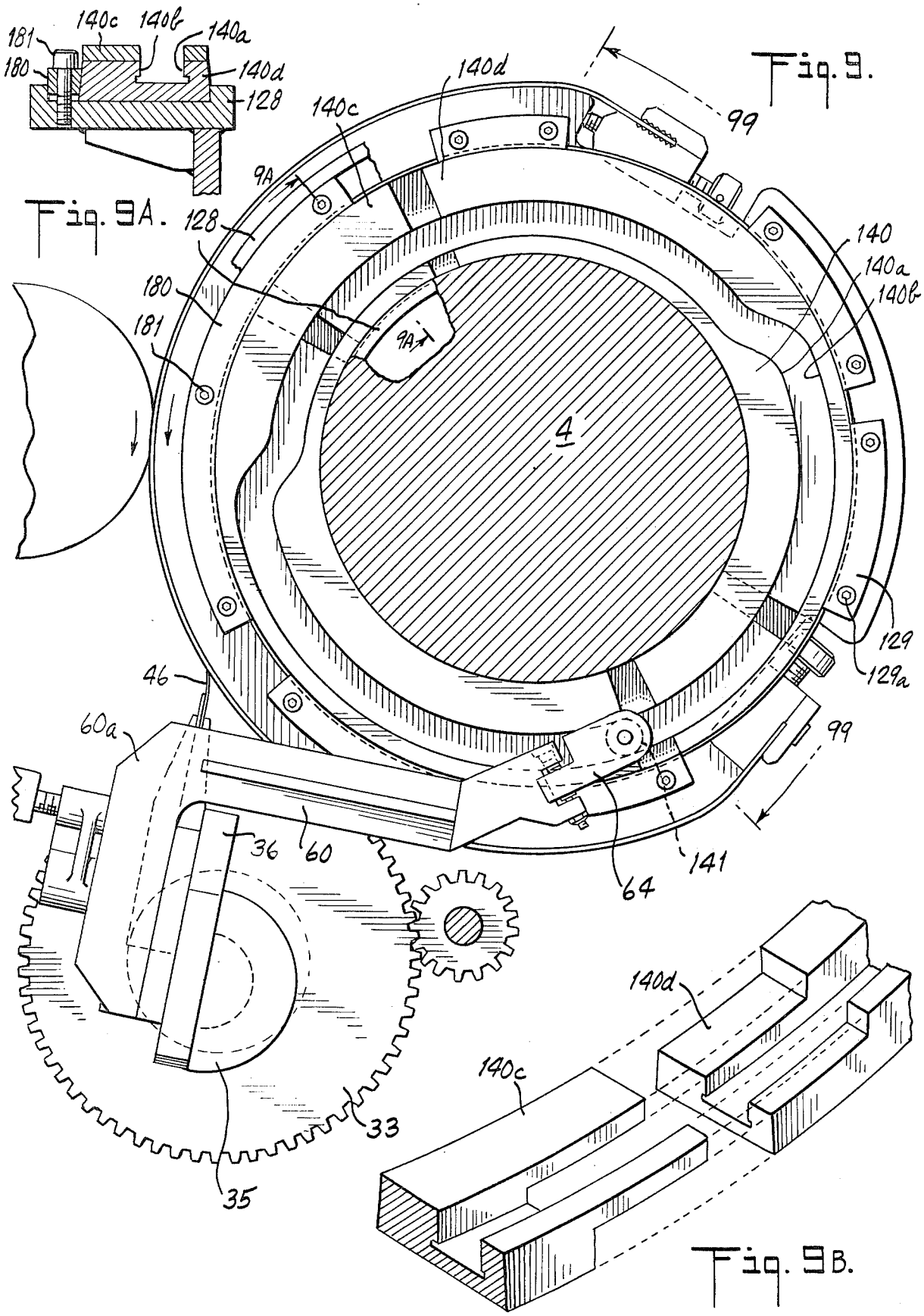
FIG. 9 is a view similar to FIG. 7, showing a modification.
FIG. 9A is a fragmentary sectional view, taken on the line 9A—9A of FIG. 9.
FIG. 9B is a fragmentary exploded perspective view, showing how the cam sections of FIG. 9 fit together.

The cam 140 includes two overlapping angularly adjustable sections, shown at 140*c* and 140*d*, each somewhat longer than a semicircle. Each of the sections 140*c* and 140*d* has its radially inner and outer sides beveled, as best seen in FIG. 9A, and is received in a supporting channel member 128, which is mounted on the plate cyliner 4. The channel member 128 has the radially inner side of its channel undercut, to match the bevel on the sections 140*c* and 140*d*. The outer sides of the sections 140*c* and 140*d* are held in the channel member 128 by a plurality of arcuate wedges 180, which are held on the channel member 128 by screws 181. The wedges 180 have their radially inner surfaces beveled to match the outer sides of the sections 140*c* and 140*d*. The position of either section 140*c* or 140*d* may be adjusted by loosening the appropriate screws 181. Thus, the angular positions of the plate cylinder 4 where the blade 46 first engages the plate and where it separates from the plate may be independently adjusted with the cam structure of FIG. 9. In the structure of FIG. 7, any adjustment of the angular position of the riser section 67*a* necessarily entails a concomitant adjustment of the drop-off section 67*b*, which thereafter has to be adjusted to compensate for the movement introduced by the adjustment of the riser 67*a*. The cam adjustment structure of FIG. 9 is therefore an improvement over the cam structure 67 in that that compensating adjustment does not have to be made.

The positive forcing of the cam into engagement with the plate is common to the modifications of both FIGS. 7 and 9. The positive drive of the blade 46 away from the plate at the gap 99 as in FIG. 9, follows the action of the press more closely under high speed conditions than does the spring-driven retraction of the blade as in FIG. 7.

Arm 68 of FIG. 7, being unnecessary in the modification of FIG. 9, is omitted in that figure. The other parts in FIG. 9 are the same as their counterparts in FIG. 7 and have been identified with the same reference numerals.

THE WIPING WEB—FIGS. 10–18

The first of the two wiping webs encountered by the plate cylinder 4 as it rotates is shown at 80 in FIG. 10. The second wiping web, sometimes termed a polishing web, is shown at 80*a*. Since the two webs and their associated mechanism are essentially duplicates, only the wiping web 80 and its mechanism will be described in detail.

The web 80, which may be of crepe paper, burlap or the like comes from a supply reel 81 turning on a shaft 82 supported by trunnions 83. The reel 81 is provided with an adjustable brake 84, of any suitable construction, which maintains the web under tension. The web proceeds from the reel 81 over a guide roller 85, a padded wiping bar 86 and thence between the wiping bar 86 and the plate cylinder 4. It then passes over another guide roller 87 and a drive roller 94 to a take-up reel 90 on a shaft 91 which rotates in a pair of slotted guides 92. The take-up reel 90 is supported on the drive roller 94, which is fixed on a shaft 95 carrying a pinion 96. The pinion 96 is driven by a rack 97 operated by a hydraulic reciprocating motor 100. An ajustable stop 98 limits the stroke of the reciprocating motor 100.

The hydraulic motor 100 is controlled by a cam (not shown) operating concurrently with the plate cylinder 4 and driving a follower operating a valve effective to supply hydraulic fluid to the motor 100 to advance the web 80 during those intervals when the gap 99 (FIG. 7) between the ends of the plate 9 is opposite the wiping bar 86. At that time, the web 80 passing over the wiping bar 86 is not in contact with the cylinder 4, and is free to move.

The trunnions 83 are formed in a pair of plates 101 mounted on the side plates 3*a* and 3*b* of the carriage 3 by means of bolts 102 and spacers 103. The pinion 96 is connected to the shaft 95 through a suitable conventional one-way clutch mechanism shown at 104, so that the return stroke of the rack cannot reverse the direction of rotation of shaft 95 and the take-up reel 90. Another one-way clutch 108 is located at the other end of shaft 95, and permits it to turn in only one direction with respect to the plate 101.

The wiping bar 86 is reciprocated laterally of the press by means of an apparatus illustrated in FIGS. 12–17. The bar 86 is attached at its ends to plates 88 which are mounted on a pair of sliders 105 of T-shaped cross-section (FIGS. 12 and 16). Each slider has a stem of its T-shaped cross-section supported between a pair of angle irons 106 mounted on beams 107 attached to the side plates 3*a* and 3*b*. The sliders 105 are pivotally connected to a pair of links 110 whose opposite ends are pivotally connected to a beam 111 extending transversely of the press and supported at its ends on a pair of shoes 112 slidably received between upper and lower guide rails 113 (FIGS. 12 and 17) fixed to the beam 107 and thereby to plates 3*a*, 3*b*. Another link 114 is pivotally connected at its ends to the middle of the wiping bar 86 and to the middle of the beam 111. It may be seen that the beam 111, the bar 86 and the links 110 and 114 constitute a parallelogram linkage which allows the bar 86 to be oscillated laterally with respect to the frame 3*a*, 3*b* of the carriage 3. That oscillation is produced by a motor 115 (FIG. 12) driving a belt 116 that in turn drives a pulley 117 carried by a shaft 118 journaled in the beam 111. The other end of the shaft 118 drives an eccentric 120. An arm 121 receives the eccentric 120 and is pivoted on one end of a link 122 whose opposite end is pivotally connected to the bar 86. Thus, as the motor 115 turns, it oscillates the bar 86 laterally, thereby enhancing the wiping action of the web 80.

The shaft 118 carries a second pulley 119 driving a belt 119*a* which supplies power to the oscillating mechanism of the second web 80*a*. The two oscillating mechanisms should be operated 180° out of phase with each other to minimize vibration of the auxiliary carriage 3.

The beam 111 may be advanced toward and away from the plate cylinder 4 by means of two hydraulic cylinders 160, which may act selectively either to apply pressure between the web 80 and the printing plate 9 or to relieve that pressure.

Wiping bar 86 is supported at its ends on plates 88. Each plate 88 is mounted for limited pivotal adjustment on one of the sliders 105. See FIGS. 15 and 16. Each mounting includes a pivot pin 88*a* fixed in the slider 105 and on which the plate 88 is rotatable. A pair of bolts 88*b* are also fixed in the slider 105 and are received in slots 88*c* in the plate 88. The angular position of the plate 88 may be varied with respect to the plate cylinder 4 by loosening nuts 88*d* on the bolts 88*b* so that plate 88 may be pivoted on the pin 88*a*.

By means of this angular adjustment of the plate 88, the pressure between the leading edge of the bar 86 and plate cylinder 4 may be made greater or less than the pressure between the trailing edge of the bar 88 and the plate cylinder 4. It is commonly desired to produce the greatest pressure at the trailing edge, since the quantity of excess ink reaching the trailing edge is less than that present at the leading edge.

FIGS. 13 AND 14

These figures illustrate a modification of the apparatus in FIG. 12, in which the parallelogram linkage 110, 111, 114 and 86 is replaced by a straight line travel mechanism including a beam 142 having fixed projecting arms 142*a*, 142*b* and 142*c*. Each of these arms, as illustrated in FIG. 14 in the case of arm 142*b*, has a forked end which straddles a portion of the wiper bar 86. The upper fork of each arm has a downwardly facing slot 143 in its under surface, which receives an upwardly projecting ridge 144 on the wiper bar 86. As the wiper bar 86 is oscillated, the ridges 144 reciprocate in the slots 143.

The wiper bar 86 may be driven toward the plate cylinder 4 to establish the desired wiping pressure between the web 80 and the plate 9, by means of two driving mechanisms 145, one acting on each end of the beam 142. One of the driving mechanisms 145 is shown in detail in FIG. 13*a*. The driving mechanism 145 includes a hydraulic cylinder 146 pivotally mounted on trunnions 147 supported on the beam 107. The cylinder 145 drives a piston rod 148 connected by a jointed arm 149 to a rotatable helical wedge 129 journaled in a bracket 129*a* and cooperating with another helical wedge member 130 fixed on a shoe 130*a* integral with arm 142*a* and sliding between guide rails 113 in the same manner as shoe 112 of FIG. 12. Application of hydraulic fluid under pressure to the cylinder 146 drives the helical wedge 129 in a direction to force the beam 142 toward the cylinder 4 and thereby to establish the desired wiping pressure at a web 80. The helical wedge 129 has a fixed angle of rotation in response of the fixed travel of the piston rod 148. The active position of the end of wiping bar 86 is set by adjusting a screw 129*b* on the bracket 129*a*. The inner end of screw 129*b* has a reduced diameter extension which serves as a pivot for wedge 129.

Bracket 129*a* is fixed on the beam 107. A pair of springs 145*a* are connected in tension between the ends of the beam 142 and the brackets 129*a*. These springs are effective when the hydraulic pressure is relieved in the cylinder 146 to retract the beam 142 and thereby relieve the pressure between the web 80 and the printing plate 9.

The ends of the arms 110 and 114 in FIG. 12 move in an arc as the wiper bar 86 is oscillated, so that the pressure between the wiper bar 86 and the plate cylinder 4 is reduced slightly at the end of the wiper bar travel. The straight line mechanism of FIG. 13 eliminates this reduction of pressure at the ends of the wiper bar travel, so that the wiper bar maintains a fixed pressure against the plate cylinder at all parts of its stroke.

WIPER BAR PADDING ASSEMBLY—FIGS. 2C AND 18

The wiper bar 86 has fixed on its surface opposed to the plate cylinder 4 a wedge 150. In FIG. 2C, a resilient pad 151 covers the wedge 150 and extends beyond the upper edge of the wedge and beyond the lower edge of the wiper bar 86. The pad 151 is compressed and held in place by a cover 152 of any suitable wear resistant plastic material. The pad 151 and the cover 152 are held in place on the wiper bar 86 by means of a row of screws 153 extending through the lower margins of the pad 151 and cover 152, and threaded into a bar 86.

The upper margin of the cover 152 is clamped between the two semicylindrical halves 156*a*, 156*b* of a take-up bar 156. The semicylindrical half 156*a* of the bar 156 carries at its end a pair of ratchets 157 (FIG. 12), and has projecting pivots journaled in the plates 88. The ratchets 157 cooperate with pawls 158 mounted on the plates 88. The semicylindrical half 156*b* of the bar 156 is fastend to the semicylindrical half 156*a* by means of screws 159. When installing the pad assembly, the lower margin of the cover 152 and pad 151 are first attached to the bar 86 by means of the screws 153. The pad and cover are then wrapped around the bar and the upper margin of the cover 152 is clamped between the halves of the bar 156. The bar is then rotated to tighten the cover 152 and compress the pad 151. The ratchets are effective to hold the bar in its pad-compressing position.

The wedge 150 ensures that the pressure between the cover 152 and the plate 9 increases gradually from zero at the leading edge of the wiper bar, and is greatest at the trailing margins of the wiper bar. The padding assembly of FIG. 2C is known in the art.

FIG. 18 shows an improved, readily replaceable cover pad assembly structure for a modified wiper bar 86'. In this modification, the wedge 150, pad 151, and cover 152 are the same as in FIG. 2C. At the lower margin of the pad assembly, a flat bar 154 extends along the full length of the outside of the cover. Another bar 155 of a generally T-shaped cross-section extends along the full length of the inner side of the pad 151. The bars 154 and 155 and the pad 151 and cover 152 are first fastened together as an assembly by a plurality of spaced screws 154*a*. The wiper bar 86' is provided with recesses interfitting with the bar 155 for receiving that bar with a sliding fit. The entire assembly may be inserted endwise in or removed endwise from the wiper bar 86' from the front side of the press (as viewed in FIG. 10) after the auxiliary carriage 30 has been moved to its retracted position so as to bring the wiper bar 86' into an accessible location. The upper margin of the cover 152 is clamped to the bar 156 after the assebly is inserted. The pad assembly shown in FIG. 18 is capable of easier replacement and maintenance than the conventional one shown in FIG. 2C.

LOCKING MECHANISM—FIG. 19–21

These figures illustrate the locking mechanism by which the carriage 3 and main frame 1 are locked together with the carriage in its operating position, so that the relative positions of the carriage and the main frame are not disturbed by vibration, which may be due to the mechanism for reciprocating the web, or by any other cause. The upright members 1*a* and 1*b* of the main frame 1 have fixed thereon a plurality of tapered socket members 131, best seen in FIG. 21. The side frame members 3*a* and 3*b* of the carriage 3 have fixed thereon a corresponding plurality of tapered locating pins 132. When the carriage 3 is moved to its operating position, each of the pins 132 enters a corresponding socket 131. The pins and sockets thereby prevent lateral movement between the uprights 1*a*, 1*b*, and the side frame members 3*a*, 3*b* of the carriage 3.

The side frame members 1*a* and 1*b* each carry a pair of power operated locks 133. Each lock comprises a hydraulic cylinder 134 operating a piston rod connected to a tapered pin 135 which cooperates with a mating tapered socket 136 fixed on the frame 3*a* or 3*b* of the carriage 3. After the carriage 3 has been moved to its operating position, appropriate ends of the cylinders 134 are supplied with fluid under pressure, preferably simultaneously, to drive their respective pins 135 into their associated sockets 136, thereby preventing any movement of the carriage 3 away from the main frame 1. This locking of the carriage 3 against movement away from the main frame ensures that the locking pins 132 remain tightly engaged with their sockets 131, and ensures that the carriage 3 and main frame 1 are positively locked together against any relative movement, either lateral or longitudinal. The supply of fluid under pressure to all the cylinders 134 may be controlled by a single manually operated valve (not shown). The cylinders 134 are double-acting, and the locking pins 135 may be withdrawn from their respective sockets 136 only by supplying fluid under pressure to their opposite ends.

FIGS. 22–25

Impression Cylinder Drive

The plate cylinder 4 is rotated by a motor (not shown), through gearing which may include a gear 162 fixed on a shaft 161 of the plate cylinder 4. The pressure cylinder 5 is driven from the gear 162 through a gear 163 and a resilient coupling generally indicated by the reference numeral 165, shown in FIGS. 22–25, which connects the gear 163 to the shaft 164 of pressure cylinder 5.

The coupling 165 includes a hub 166 fixed on the shaft 164 and carrying a plate 166*a* on which are mounted four posts 167, extending outwardly from the plate (to the right in FIG. 22) and equally spaced near the periphery of the plate 166*a*. Gear 163 is rotatable on the shaft 164, outwardly of the plate. Fixed on the gear 163 is a second set of four inwardly extending posts 170. Each post 167 has adjustably mounted thereon a spring retainer 172, facing an adjacent spring retainer 171. A spring 173 is held in compression between each facing pair of retainers 171 and 172. The position of spring retainer 172 is adjustable by means of a screw 174, whose position may be locked by means of a set screw 175.

When the cylinders 4 and 5 are rotating and not in pressure contact, the torque for driving cylinder 5 is transmitted through gears 162 and 163, posts 170, springs 173, posts 167 and hub 166 to the shaft of cylinder 5.

The plate cylinder 4 has an external surface consisting of a printing plate, supported by the rigid cylinder. The structure of the pressure cylinder is similar, except that there are several peripheral layers, all of which are of compressible material. The printing plate may have minor variations in thickness, within prescribed tolerance limits. The layers on the pressure cylinder are also subject to variations in thickness, because of the tolerances permitted in constructing the layers. The diameter of the cylinders 4 and 5 may therefore not be constant throughout the peripheries of those cylinders. Furthermore, they may vary from one press run to another, as the make up of the two cylinders is changed.

When the cylinders 4 and 5 have their surfaces in contact, there is a very strong force holding those cylinders in rolling engagement. Because of the dimensional differences in the diameters, as mentioned above, this force may vary as the cylinders turn. Furthermore, the line of contact between the cylinders may shift during printing to an angular position different from the angular cylinder position which that line would occupy if its location were solely determined by the driving gears. This conflict between the line of contact position determined by the rolling engagement and the line of contact position determined by the gears may cause a sliding of one cylinder relative to the other with resultant blurring of the printed lines or dots. In order to prevent any sliding movement of one cylinder relative to the other while they are in printing contact, it is desirable to let the rolling engagement of the cylinders control their angular positions, rather than having their angular positions forcibly determined by the driving gears.

The resilient coupling 165 allows the pressure cylinder 5 to roll freely by virtue of its contact with the plate cylinder 4. When the cylinder 5 goes on pressure, i.e., when it engages the leading edge of the printing plate on the cylinder 4, that cylinder may move slightly backward with respect to the plate cylinder 4. In other words, looking at FIG. 23, the posts 167 on the hub 166 may move slightly counterclockwise with respect to the posts 170, so that springs 173 are compressed, and the drive from the posts 170 is completely through the springs 173. As long as the pressure cylinder 5 remains in rolling contact with the plate cylinder 4, the springs remain compressed beyond their unloaded position, and compensate, by varying their compression, any uneven diametrical dimensions of the cylinders. There is thus no sliding between the cylinders.

When the pressure cylinder 5 comes to the end of the plate 4, the pressure between the two cylinders is relieved. The compressed springs 173 are unopposed, and move the posts 167 in a clockwise direction with respect to the posts 170, as viewed in FIG. 23. This clockwise movement is limited by a stop screw 174 fixed in one of the posts 170. The head of the screw 174 abuts against an adjacent post 167 when the pressure cylinder 5 is moving under light load. Only one such stop screw 174 is required, since almost all the torque is transmitted through the gears 162 and 163.

A stop pin 176 is fixed on the plate 166*a*, and is in the path of an extension 170*a* on one of the posts 170. The stop pin 176 and extension 170*a* limit the backward movement of pressure cylinder 5 with respect to the plate cylinder 4.

FIG. 1

This figure includes, besides the press itself, auxiliary equipment including a sheet feeder 7 and a sheet delivery mechanism 8. That equipment is conventional, and is described here only for the sake of completeness.

The sheet feeder 7 includes a sheet supplier 171 which delivers sheets to a conveyor 172. Conveyor 172 carries the sheets to a transfer cylinder 173 which transfers them to the pressure cylinder 5. Printed sheets are picked up from the pressure cylinder by a conveyor 174 and are carried back over the sheet supply mechanism 7 to a stacker 175. The stacker 175 may be provided with a board inserting mechanism 176, which periodically supplies a sheet or board of heavy material such as plywood or Masonite, to the stacker 175. The boards are effective to limit the number of sheets assembled in a single stack, thereby limiting the pressure on any sheet due to the sheets stacked above it, and reducing the possibility of transfer of the freshly printed ink between the adjacent sheets.

We claim:

1. A bank note intaglio printing press, comprising:

a. a main frame (1) supporting:
   1. a plate cylinder (4);
   2. an impression cylinder (5) cooperating with said plate cylinder;
   3. a scraper blade (46) cooperating with said plate cylinder;

b. a first auxiliary carriage (2) supporting:
   1. an ink reservoir (10);
   2. an ink supply means (11) for transferring ink from the reservoir to the plate cylinder; and
   3. ink receptacle means (12) for receiving ink removed from the plate cylinder by said scraper;
   4. said carriage being movable between an operating position in which the ink supply means engages the plate cylinder and a retracted position in which the ink supply means is spaced from the plate cylinder; and c. a second auxiliary carriage (3) supporting:
   1. a wiping web (80);
   2. supply and take-up reels (81,90) for the web;
   3. a wiping bar (86) for guiding the web in contact with the cylinder;
   4. separate pressure setting means (124,130) for each end of the bar; and
   5. adjustable stroke motor means (98,100) for advancing the web as the gap on the cylinder passes the bar;
   6. said second carriage being movable between an operating position in which the web engages the cylinder and a retracted position in which the web is spaced from the cylinder without disturbing either a pressure setting for an end of the bar or the length of said stroke.

2. A bank note intaglio printing press, comprising:

a. a plate cylinder (4);

b. intaglio plate means (9) on the cylinder having ink-receiving recesses (9*a*) separated by smooth surfaces (9*b*), said plate means extending around less than the entire periphery of the plate cylinder and having its peripheral ends separated by a gap;

c. means (10,11) for applying ink over the smooth surfaces and the recesses; and d. means (6) for removing excess ink from the plate means including:

1. a flexible blade (46) having an edge facing opposite to the direction of rotation of the cylinder and adapted to engage the smooth surfaces of the plate means, said blade making an acute angle with the portion of the plate means receding from the line of contact between the blade and the plate means;
2. blade supporting means (42,44,41,36) movable between an operating position in which the blade edge contacts the plate means and a retracted position in which the blade edge is separated from the plate cylinder;
3. cam means (67,140) connected to the cylinder for concurrent rotation therewith;
4. follower means (66,64,60,141) cooperating with the cam means;
5. means (35,60,62,64) connecting the blade supporting means to the follower means for concurrent movement therewith so that when the follower means is moved radially outwardly by the cam means, the blade moves toward the plate means;
6. means (69) biasing the follower means toward the cam means and the blade away from the plate means; and
7. said cam means cooperating with the follower means and the connecting means to force the blade edge into contact with the plate means and to flex the blade when the plate means is passing the blade edge, and to retract the blade edge from the cylinder when the gap between the ends of the plate means is passing the edge.

3. A bank note intaglio printing press, including:

a. a stationary frame (**1*a*,1*b***);

b. a plate cylinder (4) journaled in said frame;

c. intaglio plate means (9) on the cylinder having ink-receiving recesses (**9*a*) separated by smooth surfaces (9*b***), said plate means extending around less than the entire periphery of the cylinder and having its peripheral ends separated by a gap;

d. means (10,11) for applying ink over the smooth surfaces and the recesses; and e. means (6) for removing excess ink from the plate means including:

1. a flexible scraper blade (46) having an edge facing opposite to the direction of rotation of the cylinder and adapted to engage the smooth surfaces of the plate means, said blade making an acute angle with the portion of the plate means receding from the line of contact between the blade and the plate means;
2. blade supporting means (42,44,41,36) movable between an operating position in which the blade edge contacts the plate means and a retracted position in which the blade edge is separated from the plate cylinder;
3. cam means (67,140) connected to the cylinder for concurrent rotation therewith;
4. follower means (66,64,60,141) cooperating with the cam means;
5. means (35,60,62,64) connecting the blade supporting means to the follower means for concurrent movement therewith so that when the follower means is moved radially outwardly by the cam means, the blade moves toward the plate means;
6. means (69) biasing the follower means toward the cam means and the blade away from the plate means; and
7. said cam means cooperating with the follower means and the connecting means to force the blade edge into contact with the plate means and to flex the blade when the plate means is passing the blade edge, and to retract the blade edge from the cylinder when the gap between the ends of the plate means is passing the edge;

f. said supporting means for said blade comprising:

1. a member (36) pivotally mounted on said frame and having a datum surface (**36*a***) thereon;
2. blade gripper means (41,42,44) pivotally mounted on the member including two jaws (42,44) for engaging said blade; said gripper means being movable between an operating position in which one (42) of the jaws engages the datum surface and a retracted position in which said one jaw is spaced from the datum surface;
3. locking means (52,53,54) mounted on the member and movable between a locking position in which said gripper means is locked in its operating position and an unlocking position in which said gripper means may move to its retracted position; and g. means (62,63) adjustably connecting the follower means to said member, said gripper means being movable between its operating and retracted positions without disturbing the setting of the adjustably connecting means.

4. A printing press as in claim 3, including removable means (45) for fastening the other (44) of said jaws so that said other jaw may be loosened to remove the blade without disturbing the adjustment of the follower supporting means or the operating position of the gripper means.

5. A printing press as in claim 4, in which the other jaw may be completely removed without disturbing the adjustment of the supporting means or the operating position of the gripper means.

6. A printing press as in claim 5, including second removable means (43) for fastening said one jaw so that it may be removed without disturbing the adjustment of the follower supporting means.

7. A bank note intaglio printing press, including:

a. a plate cylinder (4);

b. intaglio plate means (9) on the cylinder having ink-receiving recesses (**9*a*) separated by smooth surfaces (9*b***), said plate means extending around less than the entire periphery of the cylinder and having its peripheral ends separated by a gap;

c. means (10,11) for applying ink over the smooth surfaces and the recesses; and d. means (6) for removing excess ink from the plate means including:

1. a flexible scraper blade (46) having an edge facing opposite to the direction of rotation of the cylinder and adapted to engage the smooth surfaces of the plate means, said blade making an acute angle with the portion of the plate means receding from the line of contact between the blade and the plate means;

2. blade supporting means (42,44,41,36) movable between an operating position in which the blade edge contacts the plate means and a retracted position in which the blade edge is separated from the plate cylinder;
3. cam means (67,140) connected to the cylinder for concurrent rotation therewith;
4. follower means (66,64,60,141) cooperating with the cam means;
5. means (65,60,62,64) connecting the blade supporting means to the follower means for concurrent movement therewith so that when the follower means is moved radially outwardly by the cam means, the blade moves toward the plate means;
6. means (69) biasing the follower means toward the cam means and the blade away from the plate means; and
7. said cam means cooperating with the follower means and the connecting means to force the blade edge into contact with the plate means and to flex the blade when the plate means is passing the blade edge, and to retract the blade edge from the cylinder when the gap between the ends of the plate means is passing the edge;

e. first and second vertically spaced receptacles (12) for receiving excess ink removed by the blade, each of said receptacles being movable from an ink-receiving position under the blade to an unloading position horizontally spaced from the blade; and
f. supports (13) for said receptacles, each said receptacle being cantilevered to project from its support in its unloading position (16) and means (15) locking the receptacles against tilting when in their unloading positions.

8. A printing press as in claim 7, including:
a. a carriage (2) supporting said receptacles;
b. ink reservoir means (10) on said carriage; and
c. means (11) on the carriage for transferring ink from the reservoir means to the plate cylinder;
d. said carriage being movable between an operating position in which the ink transferring means engages the plate cylinder and a retracted position in which the ink transferring means is spaced from the plate cylinder;
e. said receptacles being movable to their unloading positions in either position of the carriage.

9. A printing press as in claim 6, including
a. a main frame (1) supporting said plate cylinder;
b. locking means (20,21,23,24) for fixing the operating position of the carriage with respect to the main frame, including:
1. means (23,24) for holding the carriage against lateral movement with respect to the main frame; and
2. means (20,21) for holding the carriage against longitudinal movement with respect to the main frame.

10. A printing press as in claim 8, including:
a. A second carriage (3) supporting:
1. a wiping web (80);
2. supply and take-up reels (81,90) for the web;
3. a wiping bar (86) for guiding the web in contact with the cylinder:
4. separate pressure setting means (124,130) for each end of the bar; and
5. adjustable stroke motor means (98,100) for advancing the web as the gap on the cylinder passes the bar;
6. said second carriage being movable between an operating position in which the web engages the cylinder and a retracted position in which the web is spaced from the cylinder without disturbing either a pressure setting for an end of the bar or the length of said stroke.

11. A bank note intaglio printing press, comprising:
a. a plate cylinder (4);
b. intaglio plate means (9) on the cylinder having ink-receiving recesses (**9*a*) separated by smooth surfaces (96**), said plate means extending around less than the entire periphery of the cylinder and having its peripheral ends separated by a gap;
c. means (11) for applying ink over the smooth surfaces and the recesses; and
d. web means (80,81,90,86,110,111,114,85,87,100) for wiping the smooth surfaces of the plate means, including:
1. an elongated web (80) adapted to engage the plate means in wiping contact;
2. a supply reel (81) for the web;
3. a take-up reel (90), for the web;
4. a wiping bar (86);
5. means (110,111,114) for supporting the bar adjacent the cylinder;
6. means (85,89,87) defining a path for the web from the supply reel, between the bar and the cylinder, and thence to the take-up reel; and
7. means (100) for advancing the web during the intervals when the bar is adjacent the gap; and
e. a carriage (3) supporting the web means and rollable along an underlying surface between an active position in which the web may be held by the bar in engagement with the plate means and a retracted position in which the web is spaced from the plate means.

12. A printing press as in claim 11, including:
a. means (115,116,118,120,122) on the carriage for reciprocating the web laterally to assist the wiping action thereof;
b. a main frame (1) supporting said plate cylinder; and
c. means (131,132) for locking the carriage to the main frame when the carriage is in its active position, to prevent relative movement between the carriage and the main frame.

13. A printing press as in claim 11, including:
a. means (142,145) for adjusting the pressure of the bar against the plate cylinder;
b. a main frame (1) supporting the plate cylinder; and
c. means (133,135,136) for locking the carriage against movement away from the main frame when the carriage is in its active position.

14. A printing press as in claim 11, including:
a. a main frame (1) supporting the cylinder;
b. locating pin means for holding the carriage in its active position against lateral movement with respect to the main frame; and
c. locking means to hold the carriage against movement away from the main frame.

15. A banknote intaglio printing press comprising:
a. a plate cylinder (4);
b. ink applying means (11) for spreading ink over a plate on the plate cylinder; and
c. excess ink removal means including:

1. a web (80) of ink-absorbing material to engage the plate means in wiping contact;
2. an elongated bar (86) extending parallel to the axis of the plate cylinder, for holding the web in wiping contact with the plate cylinder; and
3. a replaceable pad assembly covering the web-facing surface of the wiper bar and having longitudinal margins extending beyond the web-facing surface and overlying other surfaces of the wiper bar;
4. said assembly including a pair of rigid elongated members (154,155), respectively attached to opposite sides of one longitudinal margin of the pad assembly, one of said members (155) and one of said other surfaces of the wiper bar having interfitting portions adapted for endwise sliding movement, said assembly being mountable on and removable from the wiper bar by endwise sliding movement.

16. A banknote intaglio printing press as in claim 15, in which said pad assembly includes:

a. a compressible layer (151);
b. a wear-resistant layer (152) covering the compressible layer;
c. clamping means (154,155,156) for one margin of the assembly including one of said pair of rigid members extending along the inner side of the assembly, the other (154) of said pair of rigid members extending along the outer side of the assembly and means (156) fastening said pair of rigid members together;
d. said interfitting portions comprising a longitudinal flange on said one rigid member and a recess in said wiper bar for receiving the flange.

17. A banknote intaglio printing press as in any of claims 1, 8 and 11, including for each auxiliary carriage:

a. locating pin means for holding the carriage in its active position against lateral movement with respect to the main frame; and
b. locking means to hold the carriage against movement away from the main frame.

* * * * *